US006913340B2

(12) United States Patent
Tanaka et al.

(10) Patent No.: US 6,913,340 B2
(45) Date of Patent: Jul. 5, 2005

(54) INK JET RECORDING APPARATUS AND CLEANING PORTION OF SUCH RECORDING APPARATUS

(75) Inventors: Hiroyuki Tanaka, Kanagawa (JP); Yasutsugu Saijo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/446,720

(22) Filed: May 29, 2003

(65) Prior Publication Data

US 2003/0227505 A1 Dec. 11, 2003

(30) Foreign Application Priority Data

Jun. 7, 2002 (JP) ..... 2002-166931

(51) Int. Cl.[7] ..... B41J 2/165

(52) U.S. Cl. ..... 347/29; 347/23; 347/30; 347/32; 347/33

(58) Field of Search ..... 347/23, 29, 30, 347/32, 33

(56) References Cited

U.S. PATENT DOCUMENTS 5,670,997 A 9/1997 Sugimoto et al.
5,975,676 A 11/1999 Saijo ..... 347/22
5,992,966 A 11/1999 Nitta et al. ..... 347/29
6,081,282 A 6/2000 Saijo ..... 347/29
6,286,931 B1 9/2001 Kawakami et al. ..... 347/32
6,293,647 B2 9/2001 Saijo ..... 347/24
6,312,093 B1 11/2001 Saijo et al. ..... 347/30
6,550,890 B2 4/2003 Saijo ..... 347/29
6,578,949 B2 * 6/2003 Takahashi et al. ..... 347/30
6,637,857 B2 * 10/2003 Shimizu et al. ..... 347/32

FOREIGN PATENT DOCUMENTS

JP 2-167752 6/1990

OTHER PUBLICATIONS

U.S. Appl. No. 10/452,501, filed Jun. 3, 2003, Kinoshita et al.

* cited by examiner

*Primary Examiner*—Stephen D. Meier
*Assistant Examiner*—Ly T Tran
(74) *Attorney, Agent, or Firm*—Fitzpatrick, Cella, Harper & Scinto

(57) ABSTRACT

The present invention provides an ink jet recording apparatus which can maintain stable recording quality by adequately removing ink remaining on discharge ports during cleaning processing of a recording head, and a cleaning mechanism portion for such a recording apparatus. After a carriage enters into a cleaning mechanism portion and a recording head is capped by a cap, when the carriage is further shifted in an advancing direction in a capping condition, one end of the cap is opened.

12 Claims, 15 Drawing Sheets

INK JET RECORDING APPARATUS AND CLEANING PORTION OF SUCH RECORDING APPARATUS

BACKGROUND OF THE INVENTION

1. Field of the Invention

The present invention relates to an ink jet recording apparatus for performing a recording operation by discharging ink from a recording head mounted to a carriage which is reciprocally shifted toward a recording medium, and a cleaning mechanism portion of such a recording apparatus.

2. Related Background Art

In serial type recording apparatuses having a serial scan system for performing a main scan along a direction transverse to a conveying direction (sub scan direction) of a recording medium, the entire recording medium is recorded by repeating operations in which an image is recorded by a recording head (recording means) mounted on a carriage that is shifted along the recording medium (main scan) and, after one line of recording is finished, the recording medium is fed by a predetermined amount (pitch conveyance) and a next line image is recorded (main scan).

Among the above-mentioned recording apparatuses, an ink jet recording apparatus is of a type in which a recording operation is performed by discharging ink from the recording means (recording head) onto the recording medium and can achieve compactness of the recording means, can record a highly fine image at a high speed and can record the image on plain paper without specific treatment. Further, the ink jet recording apparatus has advantages such as the running cost is inexpensive and the noise generated is less because the ink jet recording apparatus records using a non-impact system, and a color image can easily be recorded by using multicolor inks.

The recording head used in the ink jet recording apparatus includes an ink flow path extending from an ink reservoir (ink tank portion) to an ink discharging portion and, whenever the ink is discharged, new ink is successively supplied from the ink reservoir to the ink discharging portion. In the recording apparatus utilizing such a recording head, it is practical to provide a cleaning mechanism portion (recovery mechanism portion) for cleaning the recording head for the purpose of obtaining good image quality by stabilizing an ink discharging operation when the ink tank is replaced by a new ink tank after the ink in the ink tank is used up and the ink is re-filled in the flow path extending to the ink discharging portion or when foreign matter such as solidified ink, dirt and/or bubbles in the vicinity of an ink discharge port are removed (cleaned).

FIG. 20 is a schematic front view showing a cap open condition of the cleaning mechanism portion of a conventional ink jet recording apparatus. FIG. 21 a fragmental schematic front view showing a cap closed (capping) condition of the cleaning mechanism portion of FIG. 20. In FIGS. 20 and 21, a carriage 6, on which a recording head is mounted, is shifted in a main scan direction relative to a recording medium, such as a paper, to provide shifting and guiding movements by means of guide shafts 101*a* and 101*b* provided on a chassis 101. A part of a timing belt 103 is connected to the carriage 6, and the carriage 6 is driven along the guide shafts 101*a* and 101*b* by transmitting a rotation of a CR (carriage) motor 102 that is secured to the chassis 101 to the timing belt 103.

A cleaning mechanism portion 108 is provided, at a base side of a main body of the recording apparatus, at a position facing the recording head mounted on the carriage 6. The cleaning mechanism portion 108 is provided with a cap 104 for covering a discharge port face of the recording head. The cap 104 is used to prevent solidification of the ink and increase in viscosity of the ink in the vicinity of discharge ports by covering the discharge port face of the recording head in a record waiting condition, and to suck the ink from the discharge ports by generating negative pressure in the cap when processing for recovering clogging of the discharge ports, by connecting the cap to a negative pressure generating source. The cap 104 is formed from elastic rubber material or the like. The cap 104 is held by a cap holder 105, and the cap holder 105 holding the cap 104 is slidably mounted on a cap slider 106. A cap spring 107 is mounted between the cap holder 105 and the cap slider 106.

A shaft portion 106*a* provided on the cap slider 106 is supported so as to enable shifting and guiding movements along a cam surface (shown by chain double-dashed line) provided in the base portion of the main body of the recording apparatus. Further, the cap slider 106 is provided with an abutment portion 106*b*, which can abut against a side surface of the carriage 6, and, accordingly, after the carriage 6 enters into the cleaning mechanism portion 108 to abut against the abutment portion 106*b*, the cap slider 106 can be shifted in synchronism with the shifting movement of the carriage in accordance with the main scan shifting of the carriage 6. Further, the cap slider 106 is connected to the main body of the recording apparatus by means of a tension spring 109 so that, when the carriage 6 is not in the cleaning mechanism portion 108, the cap slider is held at a predetermined waiting position shown in FIG. 20 by means of the tension spring 109. Namely, in the cleaning mechanism portion 108 having the above-mentioned construction, when the carriage 6 enters into the cleaning mechanism portion 108, the side surface of the carriage 6 abuts against the abutment portion 106*b* of the cap slider to start the synchronous shifting movement, with the result that the cap slider 106 can similarly be shifted (slid) by the shifting (operation) of the carriage 6.

When the carriage 6 further advances in the cleaning mechanism portion 108, the cap slider 106 is gradually lifted toward the recording head by the action of the cam surface (shown by the chain double-dashed line) of the main body of the recording apparatus. As a result, the cap 104 abuts against the discharge port face of the recording head to establish the capping condition. In this capping condition, under the action of the spring pressure of the cap spring 107, the cap 104 is closely contacted with the discharge port face of the recording head. By waiting in a condition that the cap 104 is closely contacted with the recording head (condition that the discharge ports are sealed) in this way, the discharge ports and the discharge port face of the recording head can be protected.

Further, a suction tube 110 is connected to the cap 104 via the cap holder 105 and the other end of the suction tube 110 is connected to the negative pressure generating source (pump portion). Accordingly, in the condition that the cap 104 is closely contacted with the recording head, by operating the negative pressure generating source, the negative pressure can be created within the cap 104 through the suction tube 110 and the ink can be sucked from the discharge ports of the recording head by the negative pressure. Such ink suction is suction recovery processing for eliminating the clogging of the discharge ports and is one of the primary functions of the cleaning mechanism portion 108.

In the recording operation, when the shifting direction of the carriage 6 is reversed so that the carriage 6 is shifted again away from the cleaning mechanism portion 108, the cap slider 106 is gradually moved from the discharge port face of the recording head to establish the cap open condition, with the result that the image can be recorded on the recording medium by the operations of the carriage 6 and the recording head. In this way, the cleaning operation for the recording head can be performed in accordance with the position of the carriage 6 and the action of the cleaning mechanism portion (pump mechanism portion or the like).

However, the above-mentioned conventional arrangement has the following problems:

1) In the condition that the recording head is located at the capping position, after the pump mechanism is activated to suck the ink, when the carriage is shifted away from the cleaning mechanism portion to separate the recording head from the cap, a large amount of ink remains on the discharge port face of the recording head. Since ink remains on the adjacent different color ink discharge ports (discharge port arrays), different color inks may be mixed during the recording operation.

2) Further, when a large amount of ink remains on the discharge port face of the recording head, even if the ink remaining on the discharge port face is wiped by a blade (wiping processing) after the cleaning operation, the ink cannot be removed fully, and the residual ink may be readily applied to the surface of the paper.

3) When the recording head is left in the capping condition for a long time, the ink remaining in the cap may solidify and become adhered between the recording head and the cap. As a result, when the carriage moves away from the cleaning mechanism portion to start the recording operation, since the cap is stuck to the recording head, the recording head cannot be separated from the cap, which may lead to poor operation of the carriage. In the worst case, the cleaning mechanism portion may be damaged.

4) When the carriage enters into the cleaning mechanism portion to cap the recording head, the cap slider holding the cap is slid upwardly along the cam surface of the main body of the recording apparatus to abut the cap against the recording head. Thus, the reaction force of the cap spring (cap abutting force) also acts as the sliding load of the carriage, with the result that a carriage motor providing adequate torque must be used. Consequently, from the viewpoint of compatibility between the required driving torque and the recording quality and the cost, the selection of the motor to be used will be limited. Further, if the cam surface of the main body of the recording apparatus is made to have a gentle cam slope to reduce the sliding resistance of the carriage, when the cleaning processing of the recording head is performed by the cleaning mechanism portion, a shifting range of the carriage is widened, with the result that it becomes difficult to reduce the size of the main body of the recording apparatus.

SUMMARY OF THE INVENTION

The present invention can provide an ink jet recording apparatus which can maintain stable recording quality by adequately removing ink remaining on discharge ports when cleaning processing of a recording head is performed, and a cleaning mechanism portion for such a recording apparatus.

The present invention can also provide an ink jet recording apparatus for performing a recording operation by discharging ink from a recording apparatus, comprising a carriage on which the recording head is mounted and which is shifted reciprocally, a cap for capping an ink discharge portion of the recording head, and a cleaning mechanism portion for performing the capping by shifting a cap slider holding the cap along a cam surface by utilizing the shifting movement of the carriage, wherein after the carriage enters into the cleaning mechanism portion to cap the recording head by means of the cap, when the carriage is further advanced toward the entering direction in a capping condition, one end of the cap is opened or released.

BRIEF DESCRIPTION OF THE DRAWINGS

FIG. 3A is an explanatory view showing an arrangement of a black discharge port array and color discharge port arrays in the discharge port face, FIG. 3B is an explanatory view showing a positional relationship between the black and color discharge port arrays and a suction port of a cap (cap one end open side as well) and FIG. 3C is an explanatory view showing another arrangement of the black and color discharge port arrays and the suction port of the cap;

Figure 1:
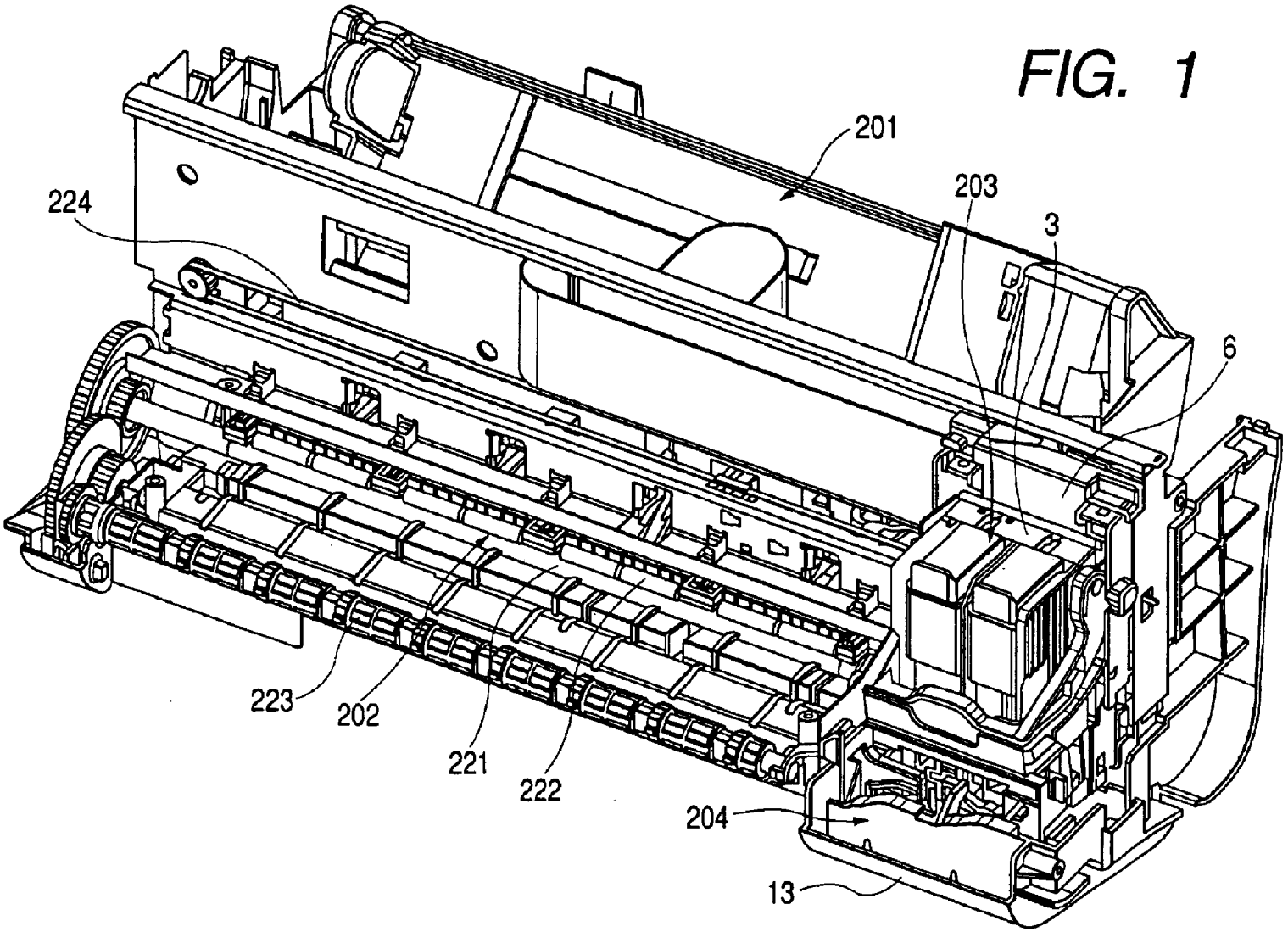
FIG. 1 is a schematic perspective view showing a first embodiment of an ink jet recording apparatus having a cleaning mechanism portion, to which the present invention is applied.

DESCRIPTION OF THE PREFERRED EMBODIMENTS (First Embodiment)

Now, an embodiment of the present invention will be explained with reference to the accompanying drawings. In the drawings, the same or similar elements or parts are designated by the same reference numerals.

FIG. 1 is a schematic perspective view showing a first embodiment of an ink jet recording apparatus to which the present invention is applied. In FIG. 1, the illustrated ink jet recording apparatus includes a sheet feeding portion 201 for supplying a recording material such as a recording paper into a main body of the recording apparatus, a conveying portion 202 for conveying the recording material through the main body (recording portion and the like) of the recording apparatus, a recording mechanism portion 203 for recording an image (including a character and/or a symbol) on the recording medium on the basis of image information, and a cleaning mechanism portion (recovering mechanism portion) 204 for maintaining a quality of the image formed by the recording mechanism.

Recording materials, such as recording papers, stacked on the sheet feeding portion 201 are separated and fed one by one by means of a sheet feeding roller driven by a sheet feeding motor and the separated recording material is sent to the conveying portion 202. The recording material sent to the conveying portion 202 is conveyed through the recording portion by a friction conveying force of a conveying roller 221 driven by a conveying motor and a pinch roller 222 urged against the conveying roller. In the recording portion, the image (including a character and/or a symbol) is recorded on the recording material by the recording mechanism portion 203 while feeding the recording material (pitch conveyance). The recorded recording material is pinched between a sheet discharging roller 223 and a spur roller cooperating with the sheet discharging roller to convey the recording material out of the main body of the apparatus.

The recording mechanism portion 203 comprises a carriage 6 guided and supported for a reciprocal movement in a main scan direction within the main body of the apparatus, and a recording head 3 as recording means. The carriage 6 guides or supports the recording head 3 for reciprocal movement along guide rails provided on the main body of the apparatus. A driving force of a carriage motor is transmitted to the carriage 6 via a carriage belt 224 so that the carriage 6 is reciprocally shifted along the guide rails by the driving force of the carriage motor. By repeating a recording operation of the recording head 3 performed in synchronism with the reciprocal shifting movement (main scan) of the carriage 6 and predetermined pitch conveyance (sub scan), the entire recording material is recorded. The recovering mechanism portion (cleaning mechanism portion) 204 serves to recover and maintain recording quality to a proper (good) condition by eliminating clogging of the recording head (ink jet head) 3 in the ink jet recording apparatus and comprises pump means for sucking or discharging ink from discharge ports, cap means for covering the discharge ports, and wiping means for wiping and cleaning a discharge port face of the recording head, as will be described later.

The recording head 3 as the recording means is an ink jet recording head for discharging the ink by utilizing thermal energy and includes electrical/thermal converters for generating the thermal energy. Further, the recording head 3 conducts the recording by creating film boiling in the ink by the thermal energy applied from the electrical/thermal converters, and discharges the ink from the discharge ports by utilizing changes in pressure due to growth and contraction of bubbles generated by the film boiling. The electrical/thermal converters are provided in correspondence to plural discharge ports so that, by applying pulse voltage to the selected electrical/thermal converters in response to recording information (recording signal), the ink is discharged from the corresponding discharge ports.

Figure 2:
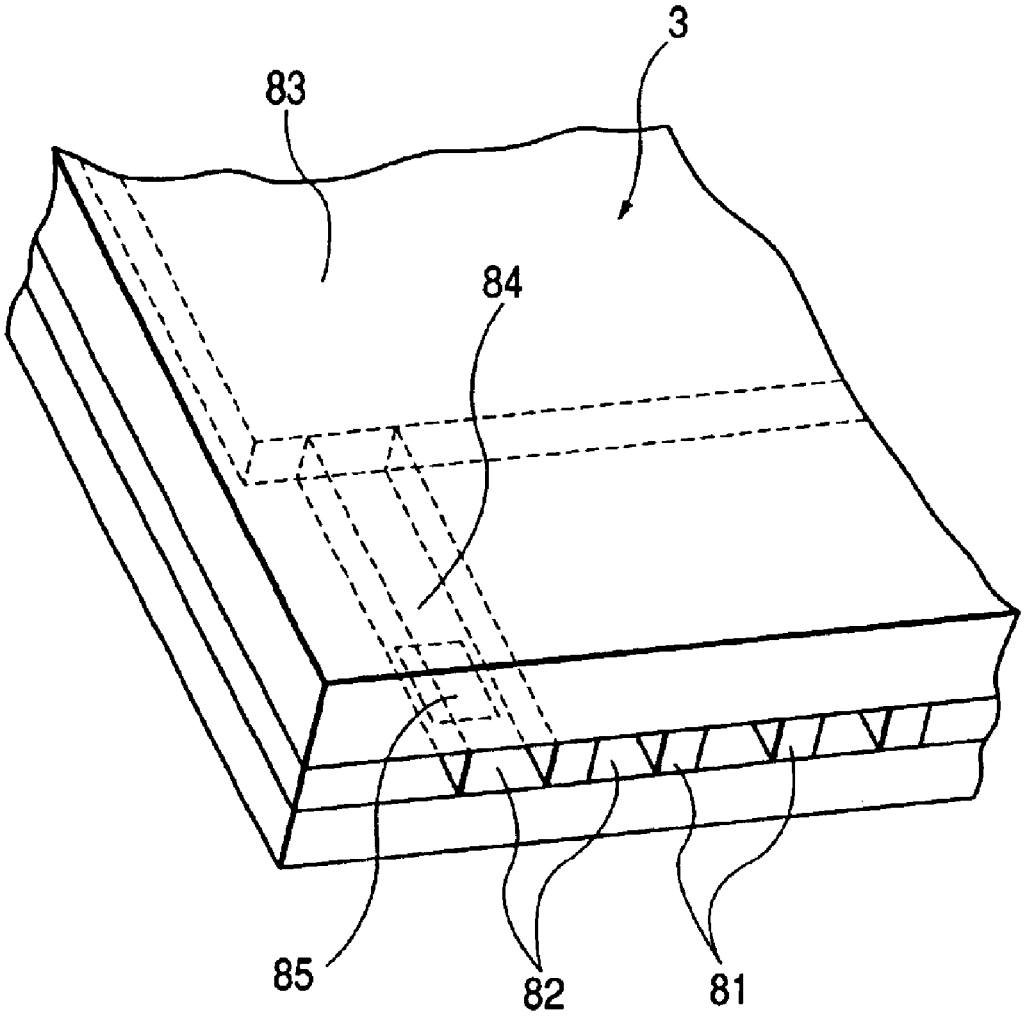
FIG. 2 is a partial perspective view schematically showing a structure of an ink discharge portion of a recording head of the ink jet recording apparatus of FIG. 1.

FIG. 2 is a partial perspective view schematically showing a structure of an ink discharging portion of the recording head 3. In FIG. 2, a plurality of discharge ports 82 are formed at a predetermined pitch on a discharge port face 81 opposed to the recording medium such as the recording paper with a predetermined gap (for example, about 0.2 mm to about 2.0 mm) therebetween, and electrical/thermal converters (heat generating resistors) 85 for generating ink discharging energy are disposed along wall surfaces of respective liquid paths 84 communicating the respective discharge ports 82 with a common liquid chamber 83. The recording head 3 is mounted on the carriage in such a manner that the discharge ports 82 are arranged side by side along a direction intersecting with the main scan direction (shifting direction of the carriage 6). In this way, the recording head for performing the recording operation by discharging the ink from the discharge port 82 by the pressure generated by the film boiling created in the ink within the liquid path 84 by driving (energizing) the electrical/thermal converter 85 in response to an image signal or a discharging signal is constituted.

Figure 3A:
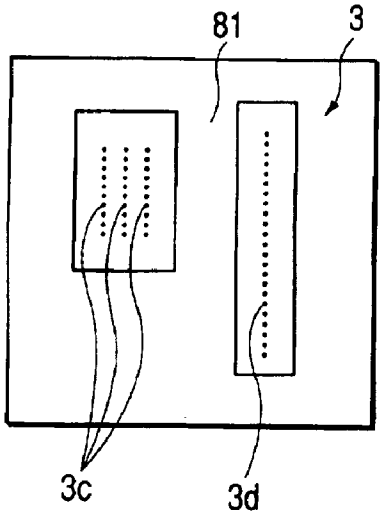
FIGS. 3A, 3B and 3C are explanatory views showing a discharge port face of the recording head according to the first embodiment of the ink jet recording apparatus to which the present invention is applied, where
Figure 3B:
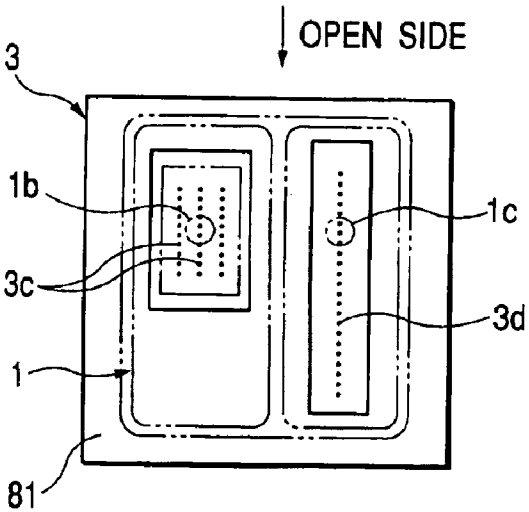
Figure 3C:
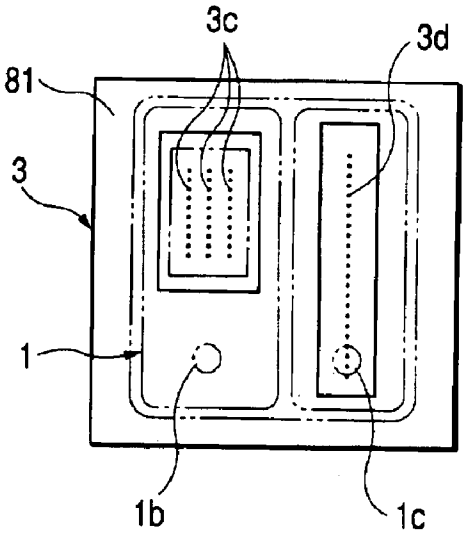
Figure 4:
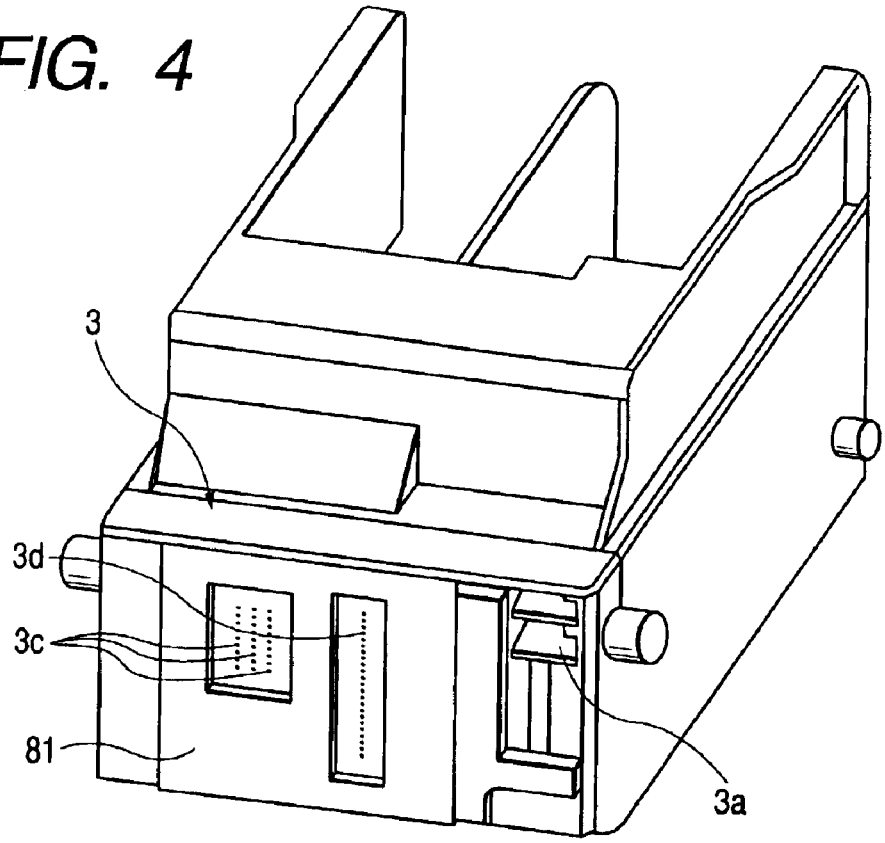
FIG. 4 is a perspective view of the recording head of the ink jet recording apparatus to which the present invention is applied, viewed from a discharge port face side.
Figure 5:
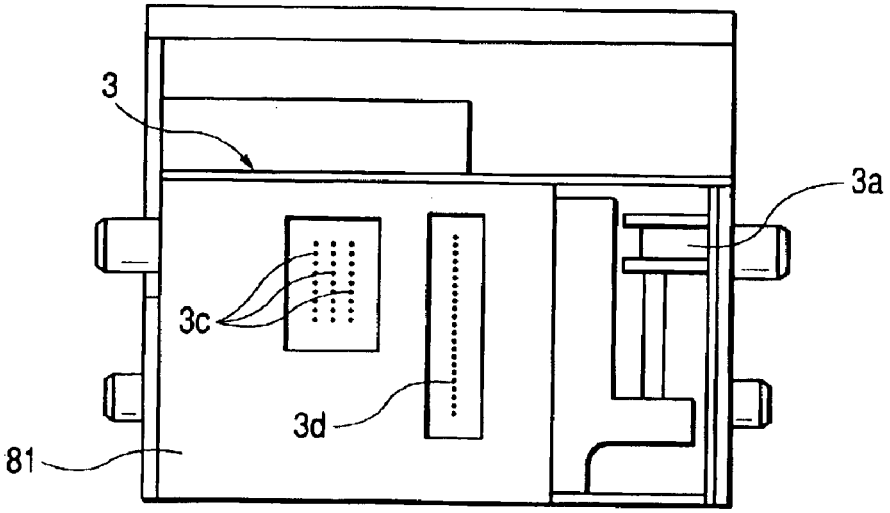
FIG. 5 is a front view of the recording head of FIG. 4, viewed from the discharge port face side.

FIGS. 3A to 3C are explanatory views showing the discharge port face 81 of the recording head according to the illustrated embodiment. FIG. 3A shows an arrangement of a black discharge port array and color discharge port arrays in the discharge port face 81. FIG. 3B is an explanatory view showing a positional relationship between the black and color discharge port arrays and a suction port (described later) of the cap (the cap one end open side as well). FIG. 3C is an explanatory view showing another (other) arrangement (positional relationship) of the black and color discharge port arrays and the suction port (described later) of the cap. FIG. 4 is a perspective view of the recording head 3, viewed from the discharge port face side, and FIG. 5 is a front view of the recording head 3, viewed from the discharge port face side. As shown in FIGS. 3A to 3C, FIG. 4 and FIG. 5, color (for example, cyan, magenta and yellow) discharge port arrays 3*c* and a black discharge port array 3*d* are formed in the discharge port face 81 of the recording head 3 according to the illustrated embodiment.

In the normal color recording ink jet recording head, when the recording (such as printing) of a pattern that includes a mixture of black and color is performed, if the black ink is superimposed at the same time onto a location where the color recording is performed, that reproduction of desired color may not be realized due to the influence of an ink fixing property. In order to avoid such a problem, in the illustrated recording head 3, lengths (in the discharge port arranging direction) of the color discharge port arrays 3*c* are selected to be shorter than a length of the black discharge port array 3*d*. Namely, with such an arrangement, the recording operation is conducted in such a manner that the ink discharging is first performed by using the discharge port at the sheet feeding side (upstream side) of the black discharge port array. The recording material (paper) is conveyed by a predetermined amount up to a location where the recording is to be performed by using the color discharge port, and then color ink is discharged from the color discharge port, thereby avoiding the above-mentioned problem. Incidentally, at the location where only the black recording is to be performed, by discharging the ink from all of the black discharge ports, the recording speed can be increased.

Figure 6:
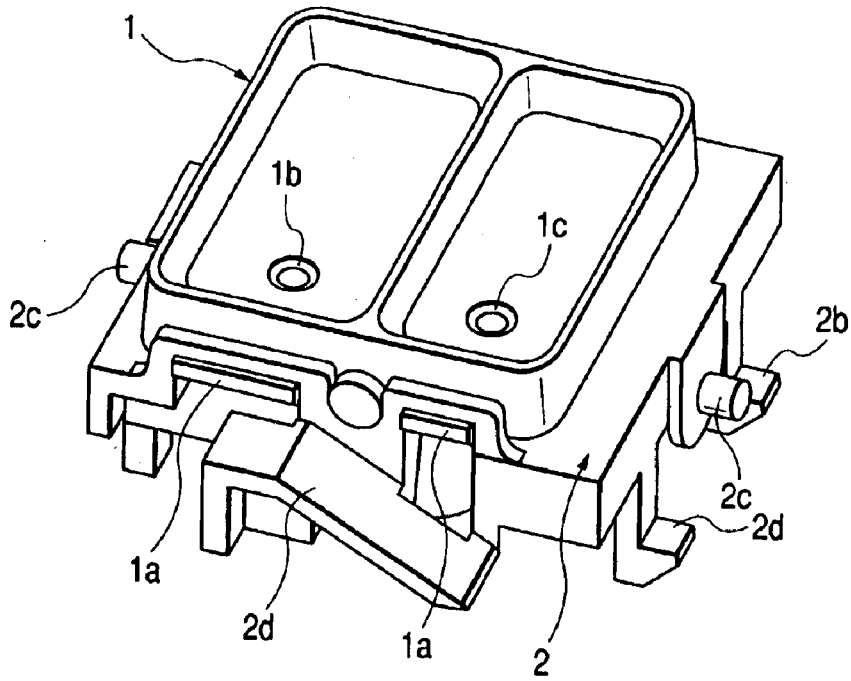
FIG. 6 is a top perspective view showing a cap and a cap holder of a cleaning mechanism portion in the first embodiment of the ink jet recording apparatus to which the present invention is applied.
Figure 7:
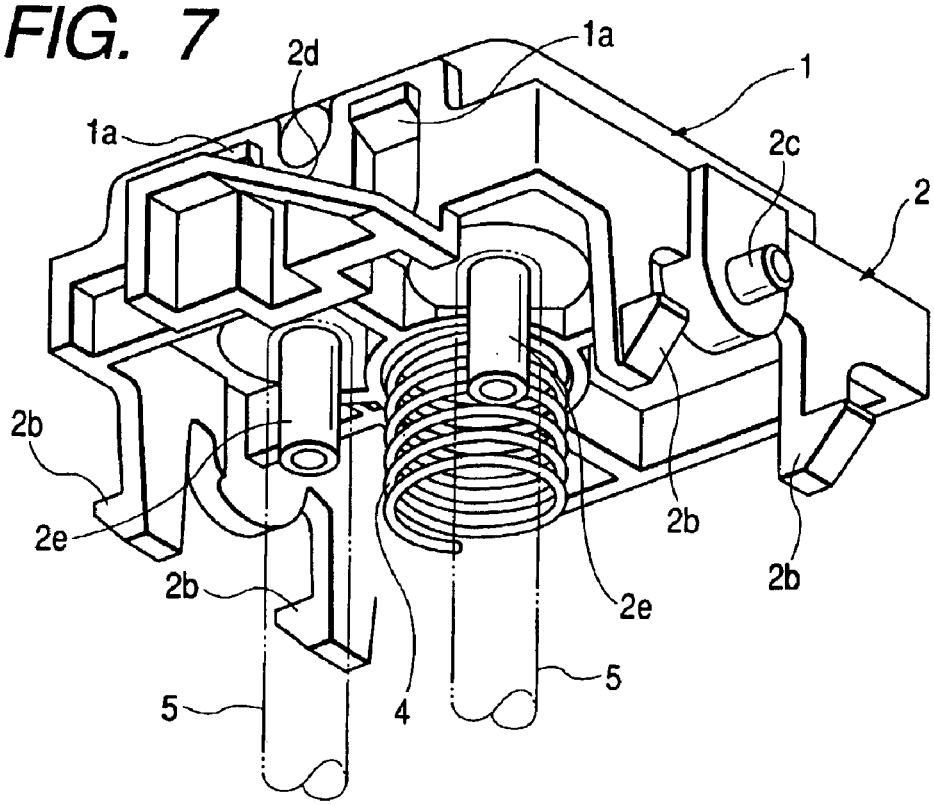
FIG. 7 is a bottom perspective view of the cap and the cap holder of FIG. 6.
Figure 8:
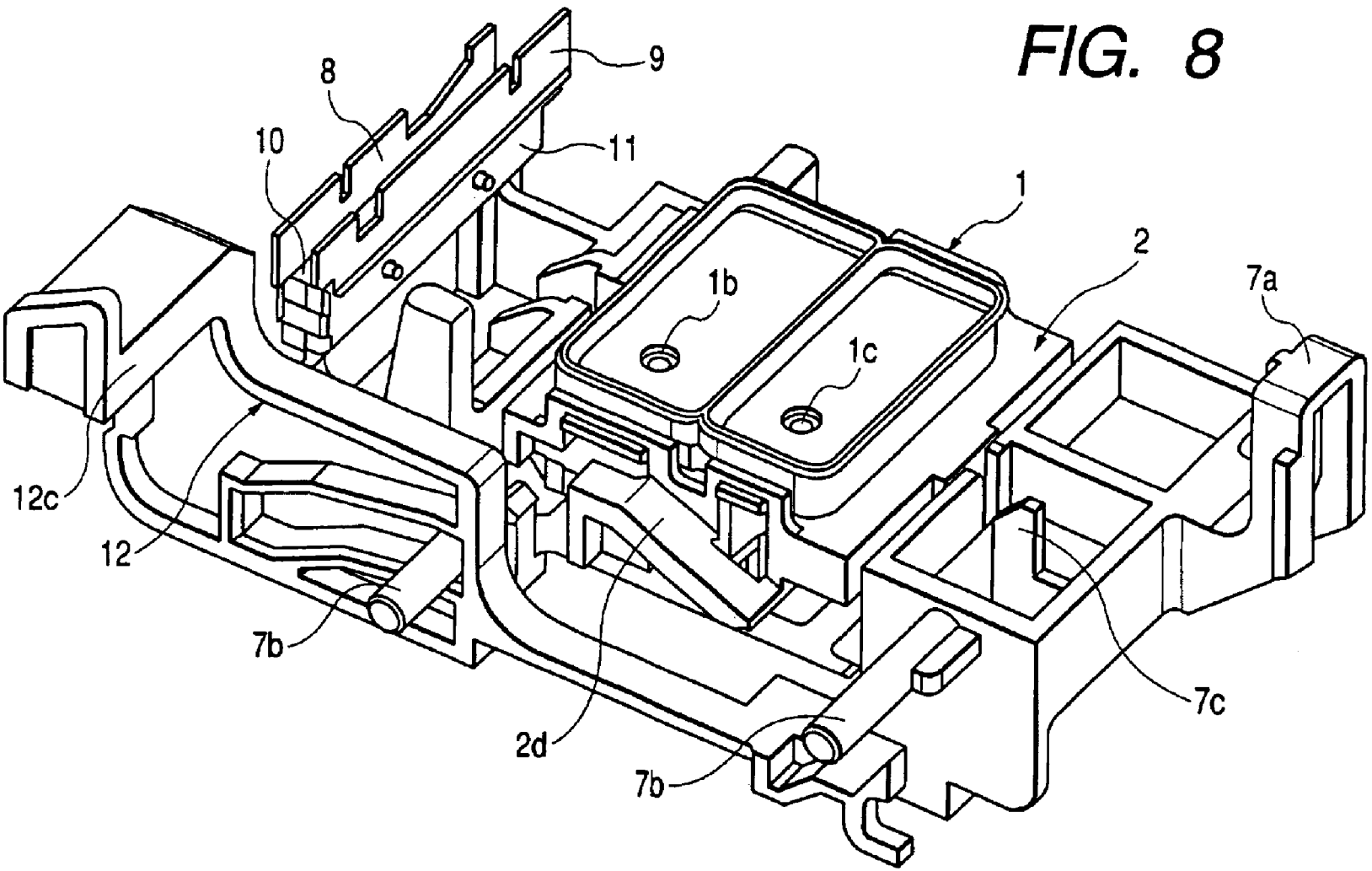
FIG. 8 is a top perspective view showing a construction of the cap slider the cleaning mechanism portion in the first embodiment of the ink jet recording apparatus to which the present invention is applied.
Figure 9:
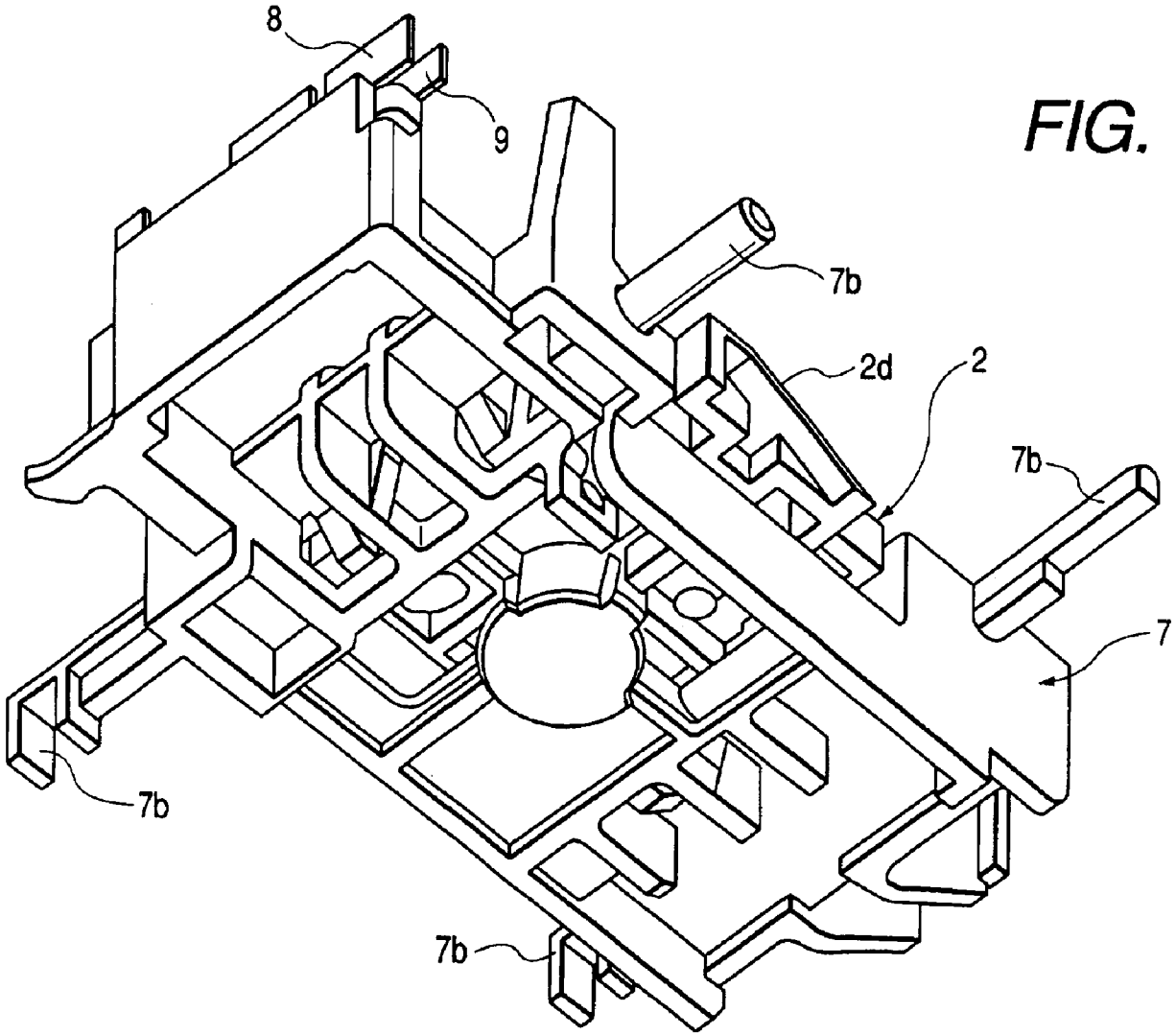
FIG. 9 is a bottom perspective view showing the construction on the cap slider of FIG. 8 in a condition that a lock lever is omitted.
Figure 10:
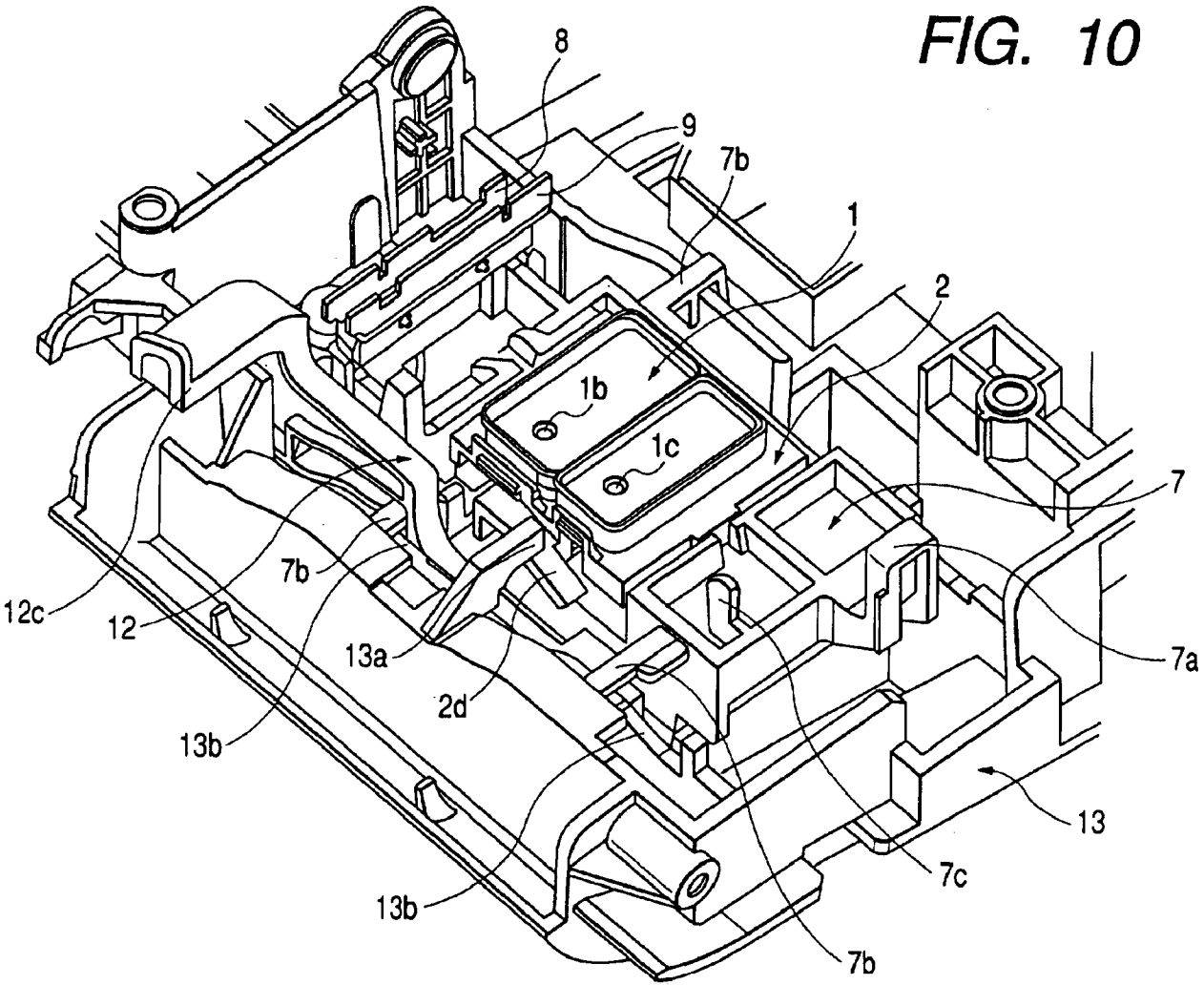
FIG. 10 is a top perspective view showing a condition at a capping position of the cleaning mechanism portion in the first embodiment of the ink jet recording apparatus to which the present invention is applied.
Figure 11:
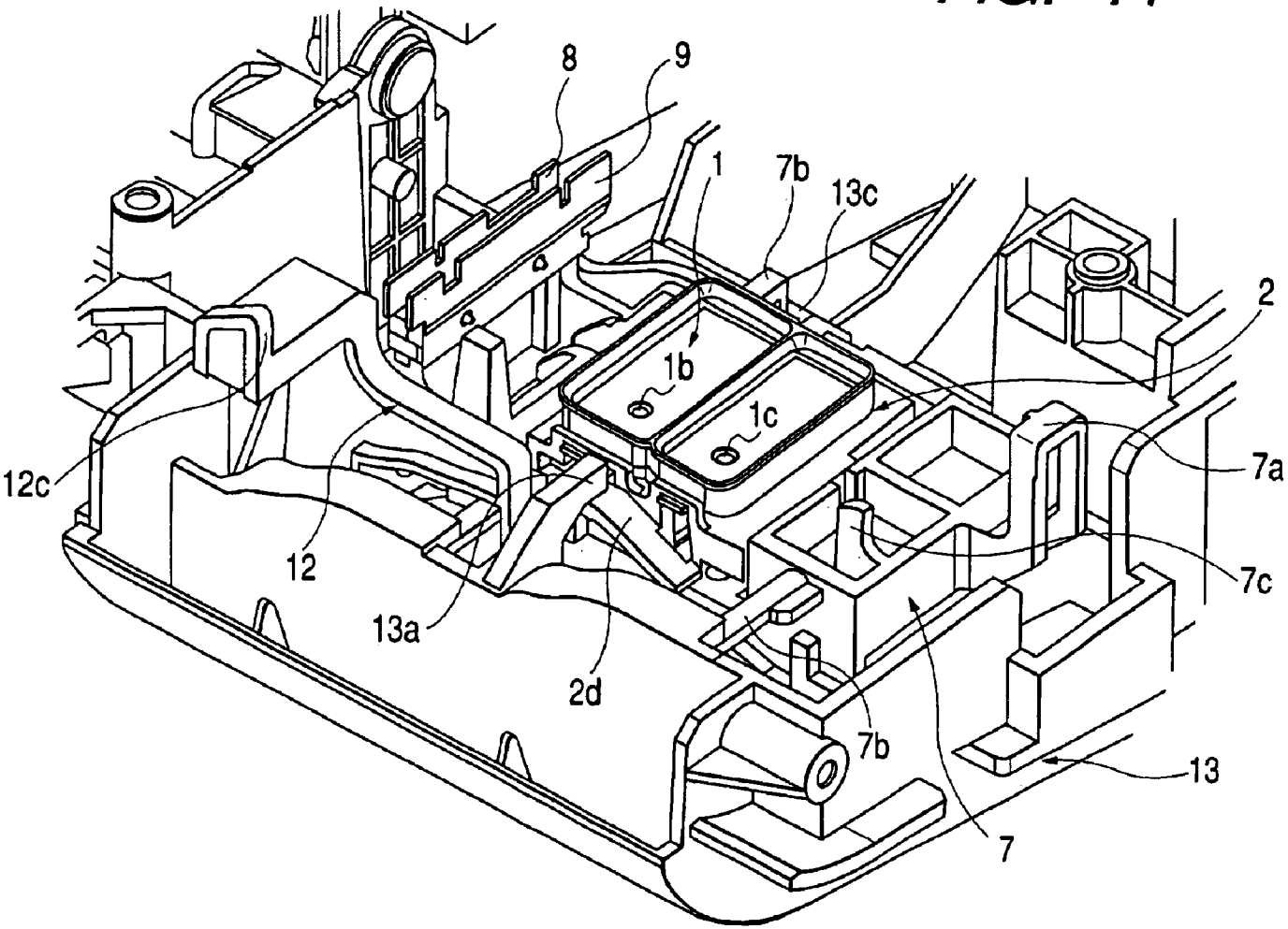
FIG. 11 is a top perspective view showing a condition at a cap open position of the cleaning mechanism portion of FIG. 10.
Figure 12:
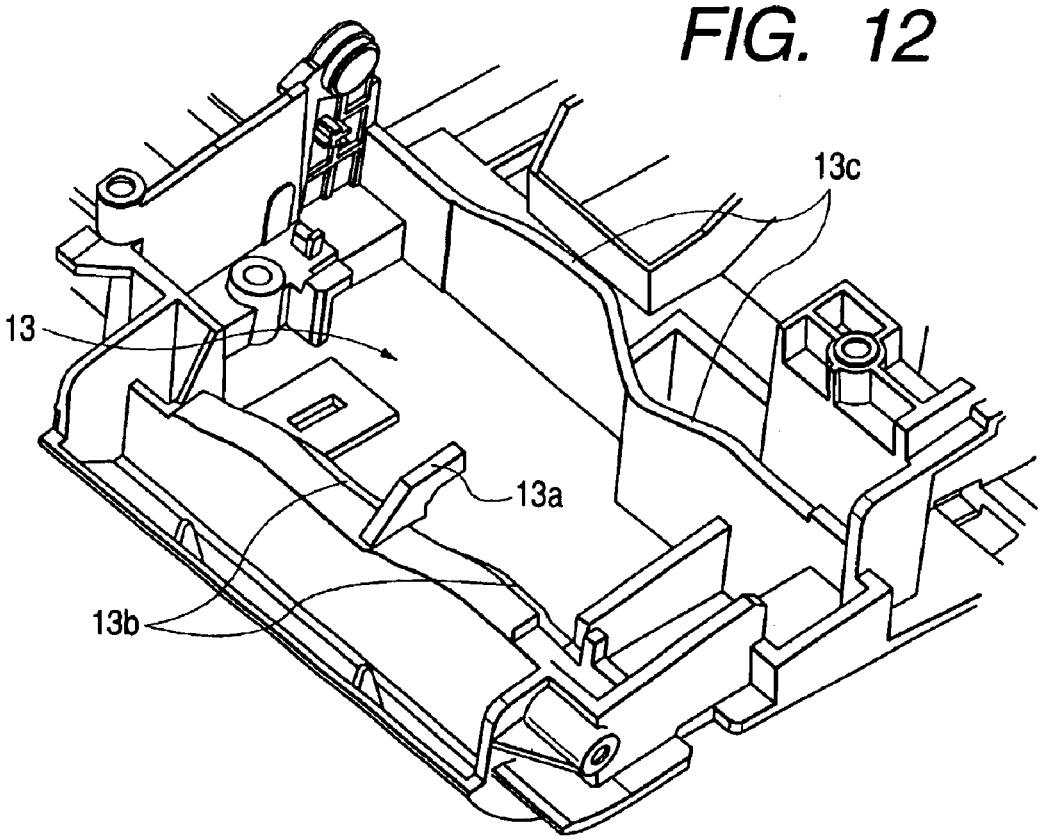
FIG. 12 is a top perspective view showing a construction of a base portion of a main body of the recording apparatus in the cleaning mechanism portion of FIG. 10.

FIG. 6 is a top perspective view of a cap and a cap holder of the cleaning mechanism portion (recovering mechanism portion) 204 in the first embodiment. FIG. 7 is a bottom perspective view of the cap and the cap holder of FIG. 6. FIG. 8 is a top perspective view showing a construction of a cap slider of the cleaning mechanism portion 204 in the first embodiment. FIG. 9 is a bottom perspective view showing the construction of the cap slider, with a lock lever omitted. FIG. 10 is a top perspective view showing a capping position of the entire cleaning mechanism portion 204 in the first embodiment. FIG. 11 is a top perspective view showing a condition at a cap open position of the cleaning mechanism portion 204 of FIG. 10. FIG. 12 is a top perspective view showing a construction of a base portion of the main body of the recording apparatus in the cleaning mechanism portion of FIG. 10.

In FIGS. 6 to 12, a cap 1 is positioned and secured with respect to a cap holder 2 by four fitting portions 1*a* and sealing portions of suction ports 1*b* and 1*c* within a cap chamber. The cap holder 2 is attached to a cap slider 7 by four hook portions (pawl portions) 2*b* to prevent the cap holder from dislodging upwardly and downwardly. Further, a cap spring 4 for biasing the cap holder upwardly is mounted between the cap holder 2 and the cap slider 7. Further, shaft portions 2*c* provided on both ends (in the carriage shifting direction) of the cap holder 2 are fitted into groove portions of the cap slider 7 so that the cap holder 2 is rotatably mounted to the cap slider 7 for a rotational movement around the shaft portions 2*c* in a front-and-rear direction (direction transverse to the shifting direction of the carriage 6). As shown in FIG. 3B and FIG. 6, positions of the suction ports 1*b* and 1*c* of the cap 1 and the cap holder 2 are selected to be positioned within a range opposed to the color discharge port arrays 3*c* if positions of the color discharge port arrays 3*c* of the recording head 3 are offset toward one side (toward a downstream side in the recording material conveying direction in the illustrated example) with respect to the cap 1.

With the above-mentioned arrangement, when the cap holder 2 is positioned and mounted at a predetermined position on the cap slider 7, the cap holder 2 can be rotated around the shaft portions 2*c* in the front-and-rear direction (direction transverse to the shifting direction of the carriage) and further can be position-corrected automatically so that a cap face (seal face) of the cap 1 abuts against the discharge port face 81 of the recording head 3 in parallel with each other when the cap slider is lifted at a capping position (position where the recording head 3 is opposed to the cap 1). Namely, the entire cap face is closely contacted with the discharge port face 81 automatically and uniformly, thereby achieving a positive sealing function. Further, the cap holder 2 is provided with a cap open cam surface 2*d* having two surfaces (oblique surfaces), that is, an oblique surface and a horizontal surface, formed along the shifting direction of the carriage at a position in a direction transverse to a line connecting between the two shaft portions 2*c*.

Further, tubes 5 are connected to positions corresponding to the suction ports 1*b* and 1*c* of the cap holder 2 and these tubes are connected to a pump mechanism portion (not shown) as negative pressure generating means. Accordingly, in a condition that the recording head 3 is capped by the cap 1, by activating the pump mechanism portion, a negative pressure condition is created within the cap 1 via the tubes 5, with the result that the ink can be sucked (drawn out) from the discharge ports of the recording head 3. Although the cap 1 according to the illustrated embodiment has a divided structure in which the interior of the cap is partitioned into two compartments so that inks from the color discharge port arrays 3*c* and the black discharge port array 3*d* of the recording head 3 can be sucked independently, a structure having no partition or a divided structure having three or more compartments can be used depending on the arrangement of the discharge port arrays of the recording head 3 and/or the sucking method, and, in such a case, similar operation and function can be achieved.

The cap slider 7 holding the cap holder 2 is connected (joined) to the base portion 13 of the main body of the recording apparatus via a slider spring 15. Further, four rod-shaped protruded portions (slider shaft portions) 7*b* are provided on side surfaces of the cap slider 7 and these protruded portions 7*b* are rested on (abut against) slider controlling cam surfaces 13*b* and 13*c* provided on the base portion 13. Namely, the cap slider 7 is so mounted as to enable a shifting movement in the carriage shifting direction along the cam surfaces 13*b* and 13*c* while controlling a vertical position of the cap slider in a condition that the respective protruded portions (slider shaft portions) 7*b* are urged against the cam surfaces 13*b* and 13*c* of the base portion 13 by the slider spring 15. Incidentally, in this application, the cam mechanism includes the cam surfaces and abutment portions (abutment members, counter-cam surfaces and the like), such as the protruded portions abutting against the cam surfaces for controlling the movements and positions of various members, and both of or any one of members (portions) constituting the cam mechanism are referred to as "cam portions" or "cam surfaces."

Among the four protruded portions (slider shaft portions) 7*b*, tip ends of several portions (two protruded portions at an upstream side in the recording material conveying direction in the illustrated example) are provided with recessed portions (groove portions) for positioning the cap slider 7 by pinching a rib portion forming the cam surface 13*c* of the base portion therebetween. The cap slider 7 is provided with an abutment portion 7*a* against which the carriage 6 or the recording head 3 entering into the cleaning mechanism portion 204 abuts. Namely, when the carriage 6 is shifted into the cleaning mechanism portion 204 to abut the side surface of the carriage 6 against the abutment portion 7*a*, the slider 7 is also shifted in accordance with the entering of the carriage 6 into the cleaning mechanism portion.

Further, the base portion 13 is provided with a fixed cam portion 13*a* adapted to open one end of the cap 1 and horizontally extending toward the cap holder 2. The cam portion 13*a* serves to open one end of the cap 1 (end at a downstream side in the recording material conveying direction in the illustrated embodiment) in the capping condition by abutting against a cap open cam surface 2*d* of the cap holder 2. Wiper blades 8 and 9 for wiping and removing foreign matter such as residual ink remaining on the discharge port face 81 of the recording head 3 are attached to the end of the cap slider 7. These wiper blades 8 and 9 are attached to the cap slider 7 via a blade spacer 10 and are held at predetermined positions on the cap slider 7 by a metal plate blade stopper 11 having a spring property. Further, the cap slider 7 is provided with a fitting pin 7*c* to be fitted into (or engaged with) a fitting hole (groove) 3*a* (FIGS. 4 and 5) formed in the recording head 3 or the carriage 6 with a predetermined gap L1 (refer to FIG. 14) therebetween.

Figure 13:
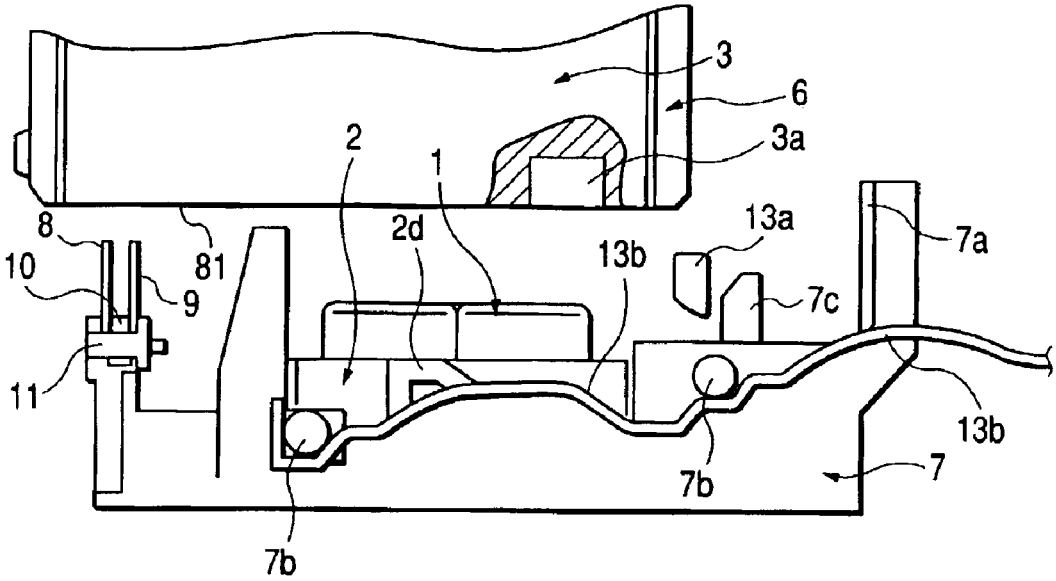
FIG. 13 is a schematic front view showing a condition achieved when a carriage and the recording head approach the cleaning mechanism portion in the first embodiment of the cleaning mechanism portion of the ink jet recording apparatus to which the present invention is applied.
Figure 14:
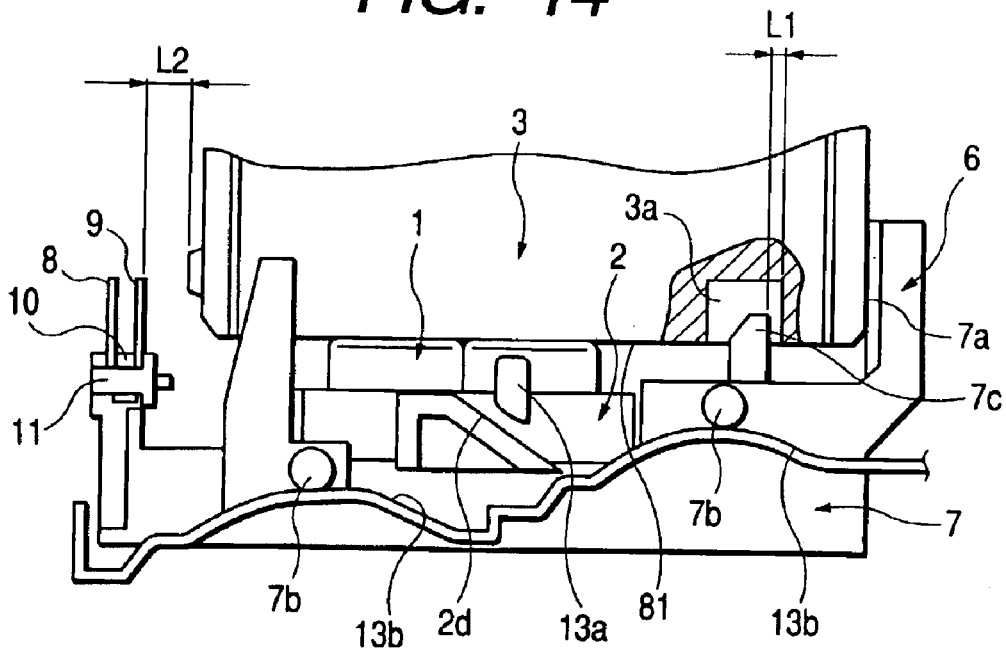
FIG. 14 is a schematic front view showing a capping condition where the cap is closely contacted with the discharge port face by shifting the cap slider in accordance with the entering of the carriage and the recording head into the cleaning mechanism portion, in the cleaning mechanism portion of FIG. 13.
Figure 15:
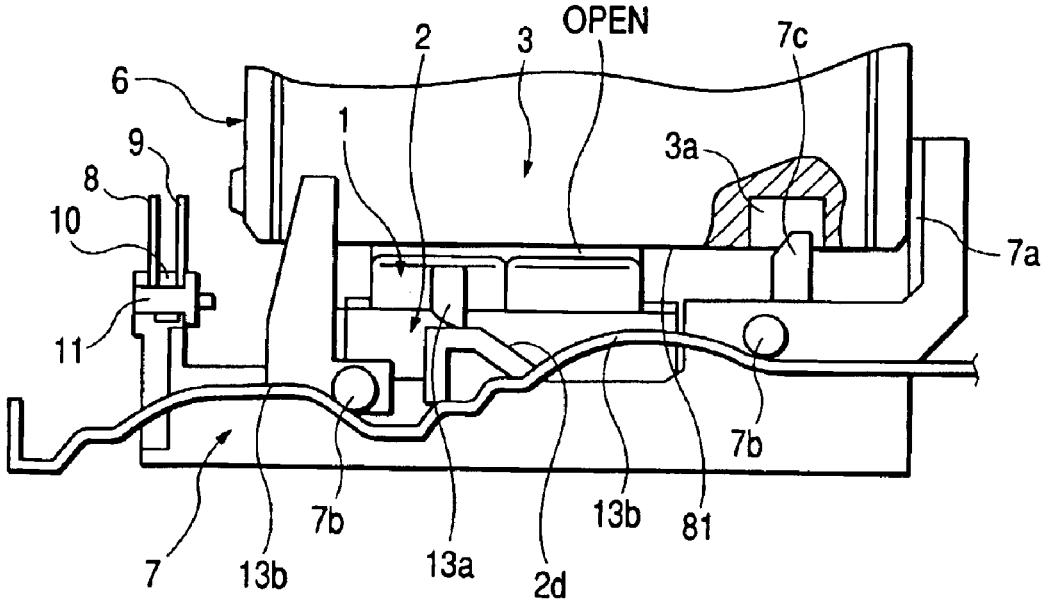
FIG. 15 is a schematic front view showing a cap one end open condition where one end of the cap is opened by further advancing of the carriage and the recording head in the capping condition of FIG. 14.
Figure 16:
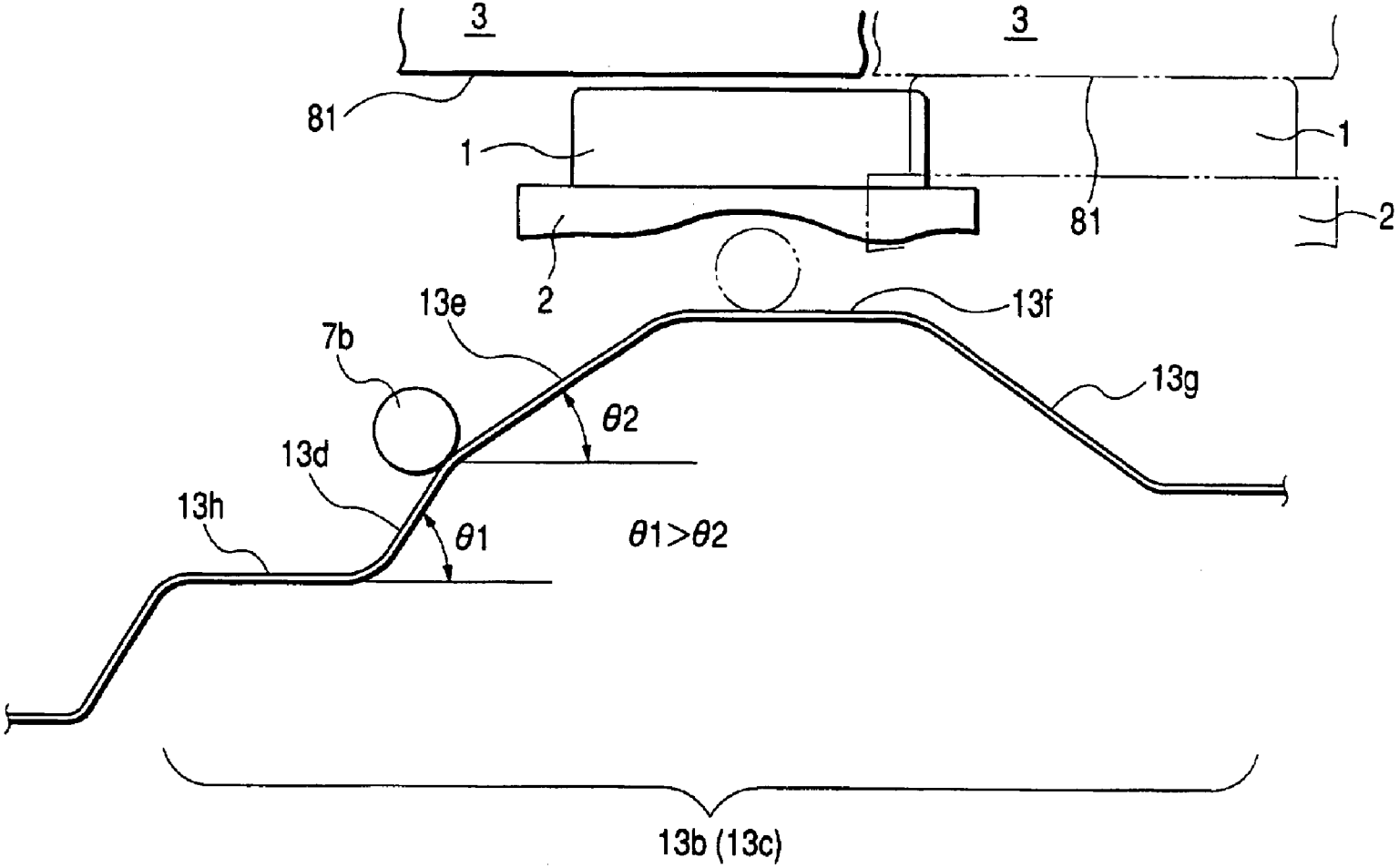
FIG. 16 is a schematic view for explaining a cam surface of the base portion and an action of the cam surface for controlling the position of the cap slider in the first embodiment of the cleaning mechanism portion of the ink jet recording apparatus to which the present invention is applied.
Figure 17:
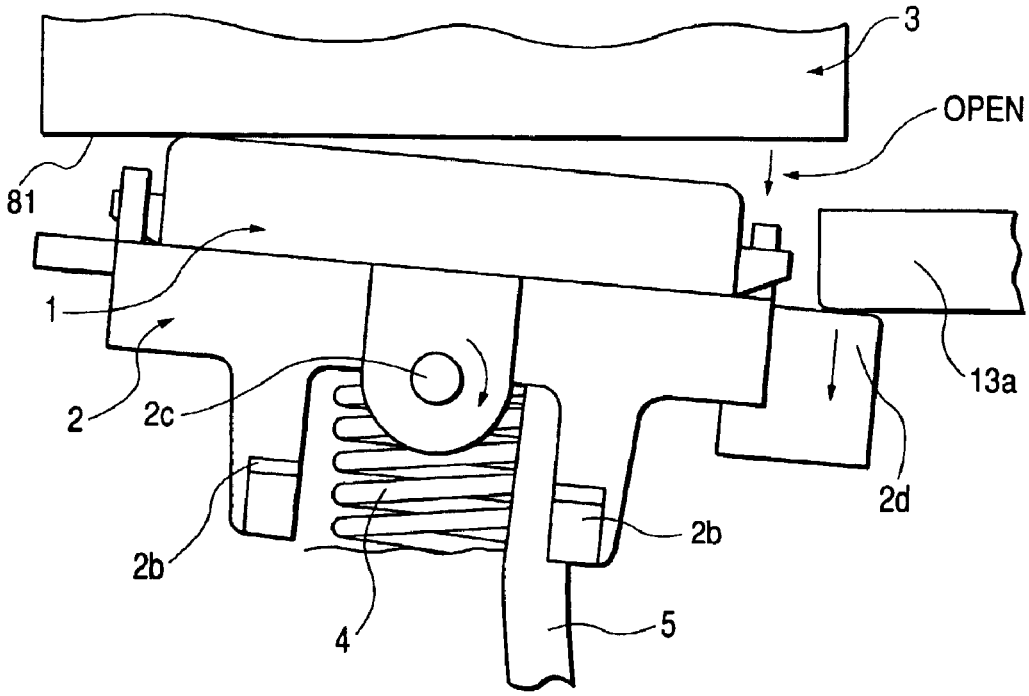
FIG. 17 is a schematic side view showing the cap open condition of the cleaning mechanism portion of the ink jet recording apparatus of FIG. 15, to which the present invention is applied.
Figure 18:
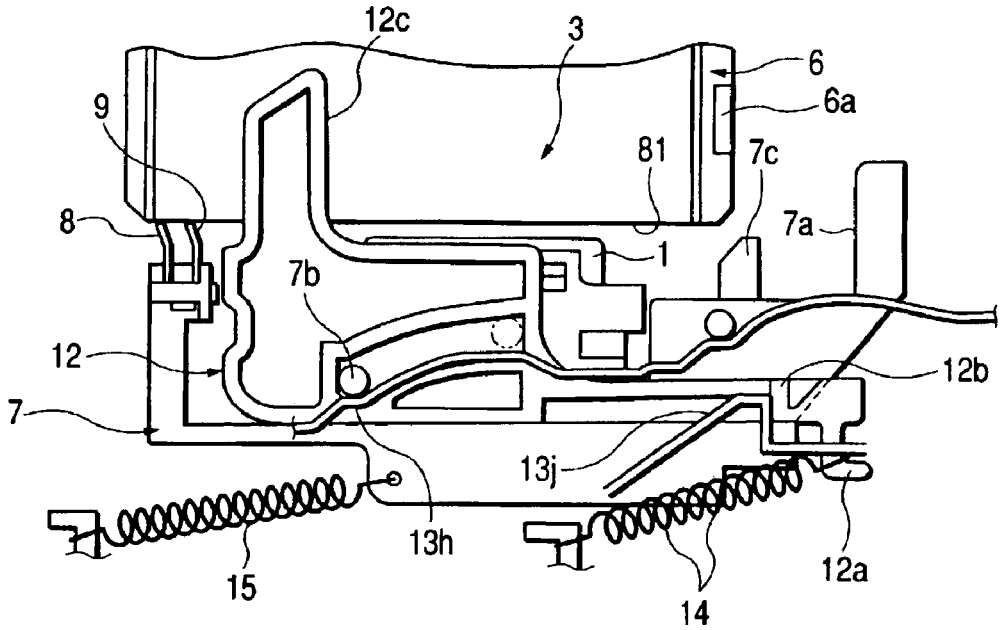
FIG. 18 is a schematic front view showing an operating condition of a lock lever provided on the cap slider so as to enable a sliding movement in the shifting direction of the carriage in the cleaning mechanism portion of the ink jet recording apparatus to which the present invention is applied.

FIG. 13 is a schematic front view showing a condition when the carriage and the recording head approach the cleaning mechanism portion, but do not yet abut against the cap slider. FIG. 14 is a schematic front view showing a capping condition when the carriage and the recording head enter into the cleaning mechanism portion and shift the cap slider accordingly to thereby closely contact the cap with the discharge port face. FIG. 15 is a schematic front view showing a cap one end open condition where one end of the cap is opened when the carriage and the recording head further advance in the entering direction in the capping condition. FIG. 16 is a schematic view for explaining the cam surface of the base portion and a function of the cam surface for controlling the position of the cap slider of the cleaning mechanism portion. FIG. 17 is a schematic side view showing the cap one end open condition of FIG. 15. FIG. 18 is a schematic front view showing an operating condition of a lock lever provided on the cap slider so as to enable a sliding movement in the carriage shifting direction.

When the carriage 6 and the recording head 3 are situated in positions (as shown in FIG. 13) where the carriage and the recording head do not yet enter into the cleaning mechanism portion, the carriage 6 and the recording head 3 are spaced apart from the wiper blades 8 and 9 with predetermined clearance in the vertical direction, and, thus, the carriage and the recording head do not abut against the wiper blades. When the capping condition of the recording head 3 (condition when the discharge port face 81 is covered by the cap 1), as shown in FIG. 14, is achieved by lifting the cap slider 7 by means of the carriage 6 entering into the cleaning mechanism portion, the wiper blade 9 is positioned to have predetermined clearance L2 with respect to the carriage 6, and, thus, in the capping condition, the carriage does not contact with the blades 8 and 9.

In the capping condition of FIG. 14, although the fitting pin 7*c* is fitted into the fitting hole 3*a* of the recording head 3, normally, there is a gap between every side of the fitting pin and the fitting hole. In the normal capping condition, although the fitting pin 7*c* does not contact with the recording head 3, the distance (gap) L1 is selected to be smaller than the gap L2 between the carriage 6 and the blade 9 so that the carriage 6 does not contact the wiper blades 8 and 9 even if the fitting pin 7*c* is contacted with the recording head 3 due to deviation between the fitting pin and the recording head in the main scan direction. Further, in the illustrated embodiment, while an example that the fitting pin 7*c* provided on the cap slider 7 is fitted into the fitting hole 3*a* of the recording head 3 with the predetermined gap therebetween was explained, the fitting hole into which the fitting pin 7*c* is fitted with the predetermined gap may be provided in the carriage 6.

As shown in FIG. 8 and FIG. 18, a lock lever 12 slidably engaged with one of the four protruded portions (slider shaft portions) 7*b* is mounted to the cap slider 7. As shown in FIG. 18, an end 12*a* of the lock lever 12 is connected (joined) to the base portion 13 of the recording apparatus via a lock lever spring 14. Further, as shown in FIG. 18, the base portion 13 of the recording apparatus is provided with a cam portion 13*j* for the lock lever 12. The cam portion 13*j* can abut against (engage with) a cam surface 12*b* of the lock lever 12. In this way, the lock lever 12 is held to be pinched between the cap slider 7 and the base portion 13 of the recording apparatus. A detailed operation of the lock lever 12 will be described later.

Incidentally, in this application, if desired, portions (members) abutting against or engaging with opposite members by utilizing the shifting movement and/or position of the carriage may be freely provided or formed on one or both of the parts such as the carriage and the recording head mounted to the carriage. Thus, the present invention is not limited to the illustrated construction in which the members are provided on either one of the parts. Accordingly, if it is not defined specially, even when a case where the members are provided on either one of the parts is disclosed (described), the present invention includes a case where the members are provided on both of the parts.

Next, a concrete operation of the cleaning mechanism portion 204 according to the embodiment explained in connection with FIG. 1 to FIG. 18 (first embodiment) will be explained. In FIG. 13, when the carriage 6 enters into the cleaning mechanism portion 204 to perform the cleaning operation for the recording head 3, from a position where the side surface of the carriage 6 starts to abut against the abutment portion 7*a* of the cap slider 7, the cap slider 7 starts to be shifted in the main scan direction in accordance with the movement of the carriage 6. When the shifting movement of the cap slider 7 is started, the entire cap slider is shifted along the cap slider controlling cam surfaces 13*b* and 13*c* while being pushed to the right in FIG. 13 and is also shifted gradually toward the recording head 3.

When the cap slider 7 is shifted upwardly, the distance between the cap 1 and the recording head 3 is gradually decreased and, ultimately, the end face (cap face) of the cap 1 starts to abut against the discharge port face 81. Since the cap holder 2 holding the cap 1 is connected (joined) to the cap slider 7 via the cap spring 4, after the cap 1 abuts against the discharge port face 81 of the recording head, the cap holder 2 is pushed down (or shifted down) relative to the cap slider 7, opposing the cap spring 4 housed in the cap slider 7. At the same time, the urging force of the cap spring 4 is gradually increased and the cap 1 is closely contacted with recording head 3, thereby establishing the capping condition.

In this case, as mentioned above, since the cap holder 2 is mounted to the cap slider 7 so as to enable the rotational movement around the shaft portions 2*c*, the entire surface of the cap 1 is closely contacted with the discharge port face 81 uniformly while automatically correcting (equalizing) an abutment angle so that the cap is contacted with the discharge port face 81 of the recording head 3 horizontally (in parallel). As shown in FIG. 14, when the carriage 6 is shifted up to a position where the carriage ascends on the top of the cam surfaces 13*b* and 13*c* of the base portion 13 of the recording apparatus, a portion of the discharge port face 81 of the recording head 3 including the discharge port arrays is completely capped. In this capping condition, when the negative pressure is generated within the cap 1 by activating the negative pressure generating means (pump mechanism portion) connected to the tubes 5, the ink can be sucked from the discharge ports 82 of the recording head 3.

When the carriage 6 enters into the cleaning mechanism portion 204 to start pushing the cap slider 7 in the main scan direction, since the carriage 6 should be shifted by a driving force compatible with the spring force of the cap slider spring 15 gradually increasing, a sliding resistance of the cap slider 7 increases. Further, when the cap 1 starts to abut against the recording head 3, the reaction force of the cap spring 4 is also added to the carriage 6, resulting in an increase of the sliding load of the carriage 6. This means that driving torque required for the carriage motor is increased, and, thus, this leads to enlargement in size of the carriage motor.

Therefore, in the illustrated embodiment, in order to reduce the motor torque required for shifting the carriage 6 by suppressing the sliding load of the carriage 6 and to reduce the width of the apparatus, the configurations of the cam surfaces 13*b* and 13*c* that extend up to a position where the cap 1 abuts against the recording head 3, are formed as steep oblique surfaces and configurations of the cam surfaces 13*b* and 13*c* that extend from the position where the cap 1 abuts against the recording head 3 to the capping position are formed as gentle oblique surfaces. That is to say, as shown in FIG. 16, the inclined angle of the cam surface 13*b* or 13*c* of the base portion 13 is selected so that an angle θ1 of an oblique surface 13*d* extending up to the cap abutting position becomes greater than an angle θ2 of an oblique surface 13*e* extending from the cap abutting position to the capping position. By partially changing the inclined angles of the cam surface 13*b* or 13*c*, the sliding load of the carriage 6 can be suppressed. Incidentally, the reference numeral 13*f* in FIG. 16 indicates a top of the oblique surfaces of the cam portion 13*b* or 13*c*, and, when the carriage 6 ascends up to this cam position 13*f*, the capping condition when the cap 1 is closely contacted with the recording head 3 is completely established. In this capping position 13*f*, the spring pressure of the cap spring 4 acts on the recording head 3 by a required amount.

In the capping condition of the recording head 3, as shown in FIG. 14, after the ink is sucked from the discharge ports 82 by activating the negative pressure generating means (pump mechanism portion) connected to the cap 1 (after the suction recovery processing), the carriage 6 continues to be advanced to the back (the right in the illustrated embodiment) to further push the cap slider 7. As a result, the cap open cam surface 2*d* of the cap holder 2 abuts against the fixed cam portion 13*a* protruded from the base portion 13 of the recording apparatus. When the fixed cam portion 13*a* starts to abut against a horizontal portion (parallel portion) of the cap open cam surface 2*d*, a force for pushing this abutment part (part at the downstream side in the recording material conveying direction on which the fixed cam portion 13*a* is provided) downwardly acts on the cap holder 2. This force acts to lift the opposite part (at the upstream side in the conveying direction) of the cap holder 2.

Accordingly, when the carriage is further shifted from the capping position toward the inside, the cap holder 2 is rotated around the shaft portions 2*c* to open the front side (downstream side in the recording material conveying direction) end of the cap 1, and, when the carriage 6 is shifted up to the cap one end open position shown in FIG. 15, the gap (open amount) between the cap and the discharge port face 81 of the recording head 3 can be kept constant at one end of the cap 1 by a horizontal portion of the cap open cam surface 2*d* of the cap holder 2. As shown in FIG. 16, an opposite oblique surface 13*g* is formed on the cam surface 13*b* (13*c*) of the base portion 13 within a range in which the carriage 6 is shifted from the capping position (FIG. 14) to the cap one end open position (FIG. 15). The opposite oblique surface 13*g* serves to reduce the sliding load of the carriage 6 by limiting (or reducing) an abutment force between the cap 1 and the discharge port face 81 generated by the cap spring 4 within the range where the carriage 6 is shifted from the capping position (FIG. 14) to the cap one end open position (FIG. 15).

As mentioned above, by sucking the ink from the discharge ports 82 by activating the pump mechanism as the negative pressure generating means while the carriage 6 is shifted from the capping position (FIG. 14) to the cap one end open position (FIG. 15), i.e. by opening one end (end at the downstream side in the recording material conveying direction in the illustrated embodiment) of the cap 1 (that is, by releasing the close contact of the cap) while the negative pressure is being generated within the cap 1 in the capping condition, the ink remaining on the discharge port face 81 of the recording head can be removed completely (positively). The removal of the residual ink on the discharge port face 81 will be fully described later. In the conventional arrangement, the cap 1 was opened in parallel with the discharge port face 81 of the recording head. In that case, the ink remaining on the discharge port face 81 is dispersed on the entire discharge port face 81 upon opening of the cap, so that, even when the pump mechanism portion as the negative pressure generating means connected to the cap is activated in the condition when the cap 1 is opened, the ink remaining on the discharge port face 81 may not be completely removed. This results in color mixing when the ink remaining around the discharge ports contacts the adjacent different color ink.

To avoid this, in the illustrated embodiment, as shown in FIG. 3B and FIG. 17, the end sides of the discharge port arrays 3*c* and 3*d* of the recording head 3 in the capping condition, i.e., ends at the downstream side (at the front side of the main body) in the recording material conveying direction are, opened. As a result, upon opening of the cap 1, the ink flow can be directed along the discharge port arrays 3*c* and 3*d*. Further, by selecting the positions of the suction ports 1*b* and 1*c* within areas opposed to the discharge port arrays 3*c* and 3*d*, respectively, and positioning the discharge port arrays near the end of the cap 1 (open side ends shown by the arrow in FIG. 3B) as the cap one end open side, when the cap 1 is opened, the ink within the cap 1 can be fully sucked until the recording head 3 side and the cap 1 side are separated, thereby effectively removing the residual ink remaining on the discharge port face 81 of the recording head 3.

Further, as shown in FIG. 3C, in a case where the position of the suction port 1*b* is disposed remote from the positions of the discharge port arrays 3*c*, the residual ink can be removed more effectively (in a good manner) in comparison with the conventional arrangement in which the cap 1 is opened in parallel with the recording head 3. However, even if the ink is being sucked from the suction port 1*b* at the moment when one end of the cap 1 is opened, the residual ink remaining on the discharge port face 81 at a location remote from the discharge port arrays 3*c* is mainly sucked; therefore, the ink sucking amount from the discharge port face 81 is decreased, and the ink removal from the discharge port arrays 3*c* and therearound is not as large as in the above-mentioned embodiment. Namely, as in the above-mentioned embodiment, it is optimum that the suction port 1*b* be provided at the position opposed to the discharge ports. Further, in a case where the discharge ports 82 of the recording head 3, the configuration of the cap 1 and the position (direction) where the one end of the cap opens are utilized and the recording apparatus itself is inclined toward the sheet discharging direction, the ink can be removed from the discharge port face 81 of the recording head 3 more effectively by providing the suction port in the cap 1 at a downstream side in the recording material conveying direction.

When the carriage 6 is shifted up to the position (shown in FIG. 15) where one end of the cap 1 is opened, the protruded portion 7*b* (the left side slider shaft portion 7*b* at the lock lever 12 side in the illustrated embodiment) provided on the cap slider 7 is shifted along the slide groove of the lock lever 12 and then abuts against the stopper, with the result that the lock lever 12 is shifted (slid) to the right in synchronism with the cap slider 7 opposing the lock lever spring 14 (FIG. 18) disposed between the tip end 12*a* of the lock lever and the base portion 13. By such a shifting movement of the lock lever 12, as shown in FIG. 18, the cam surface 12*b* provided at the tip end of the lock lever 12 is engaged by the cam portion 13*j* of the base portion 13 for the lock lever. As a result, the lock lever 12 is fixed to a relative position (shown in FIG. 18) with respect to the cap slider 7 under the action of the lock lever spring 14.

Then, when the carriage 6 starts to shift in a direction (left direction in FIG. 18) away from the cleaning mechanism portion after the shifting direction of the carriage 6 is reversed at the innermost position (right end position illustrated) of the cleaning mechanism portion 204, the cap slider 7 follows the carriage 6 under the action of the cap slider spring 15 and the protruded portion (slider shaft portion) 7*b* thereof is shifted (slid) to the left along the cam surface 13*b*. When the carriage 6 is shifted to be retracted from the cleaning mechanism portion 204, since the cam surface 13*g* having the opposite inclination (opposite taper) is formed at the cap one end open area on the cam surface 13*b*, the sliding load regarding the cap slider 7 may be increased. Further, since the cap 1 may be stuck to the discharge port face 81 at the capping position (FIG. 14), the cap slider may not substantially follow the movement of the carriage 6 or the cap 1 cannot separate from the discharge port face 81 easily.

When the carriage 6 is shifted in the reverse direction, the cap slider 7 is naturally shifted (follows) on the cam surfaces 13*b* and 13*c* in a direction opposite to the direction along which the carriage 6 advances. According to the construction of the illustrated embodiment, when the carriage is shifted away from the cleaning mechanism portion, even if the spring force of the cap slider spring 15 cannot suddenly be maintained adequately due to occurrence of the above-mentioned inconvenience, since the fitting pin 7*c* provided on the cap slider 7 is fitted into the fitting hole 3*a* of the recording head 3, the cap slider 7 can be shifted in synchronously with the carriage 6 and, thus, the cap slider 7 can be shifted in the reverse direction to substantially follow the carriage 6.

When the carriage 6 is further shifted in the reverse direction, the cap slider 7 is lowered in accordance with the shapes of the cam surfaces 13*b* and 13*c*, with the result that the fitting pin 7*c* is disengaged from the fitting hole 3*a* of the recording head 3. Since the lock lever 12 is held not to be shifted from the lock position engaged by the cam portion 13*j* and the slider shaft portions 7*b* are held by the lock lever 12 at the position of the cam surface 13*h*, the cap slider 7 is separated from the carriage 6. Incidentally, the cam surface 13*h* is constituted by a horizontal surface in order to stably maintain the vertical gap between the discharge port face 81 of the recording head 3 and the cap 1 and permitting amounts of the wiper blades 8 and 9 relative to the discharge port face 81 when the cap slider 7 is held by the lock lever 12. When the carriage 6 is further shifted in the reverse direction (to the left illustrated), the recording head 3 mounted on the carriage 6 passes through the wiper blades 8 and 9, with the result that, as shown in FIG. 18, the discharge port face 81 of the recording head 3 is wiped (cleaned) by the wiper blades 8 and 9, thereby further removing the residual ink around the discharge port arrays 3*c* and 3*d* after the suction processing.

Thereafter, when the carriage 6 is further shifted in the reverse direction, the lock lever releasing protruded portion 6*a* provided on the carriage 6 urges the tip end portion 12*c* of the lock lever 12, with the result that the lock lever 12 is rotated in an a counterclockwise direction around the protruded portions (slider shaft portions) 7*b* of the cap slider 7, thereby releasing the lock (lock between the cam surface 12*b* and the horizontal surface of the cam portion 13*j*). As a result, the cap slider 7 can be shifted up to a position where the cap 1 is completely removed from the recording head 3 (original position before the carriage 6 enters into the cleaning mechanism portion 204). By the above-mentioned operating procedure, the cleaning operation for the recording head 3 is performed.

According to the above-mentioned embodiment, the ink remaining on the discharge port face during the recording head cleaning operation can effectively be removed with a simple construction. Thus, there is provided the ink jet recording apparatus having the cleaning mechanism portion, which can obtain good recording image quality without ink mixing. Further, by reducing the sliding load of the carriage and by preventing increase in the shifting distance of the carriage for the cleaning processing, there is provided the ink jet recording apparatus having the cleaning mechanism portion, in which the cost can be reduced due to the compactness of the carriage motor and the main body of the recording apparatus can be made compact. Incidentally, as explained previously, in the illustrated embodiment, while an example that the arrangement of the discharge port arrays of the recording head 3 is effected as shown in FIGS. 3A to 3C was explained, even when the plural color discharge port arrays 3*c* are arranged side by side in a longitudinal direction (not in the width-wise direction), by using the similar cap one end open means, the performance for removing the residual ink on the discharge port face can further be enhanced in comparison with the conventional cap parallel shifting arrangement, and there can be provided an ink jet recording apparatus which can prevent undesirable ink color mixing.

(Second Embodiment)

Figure 19:
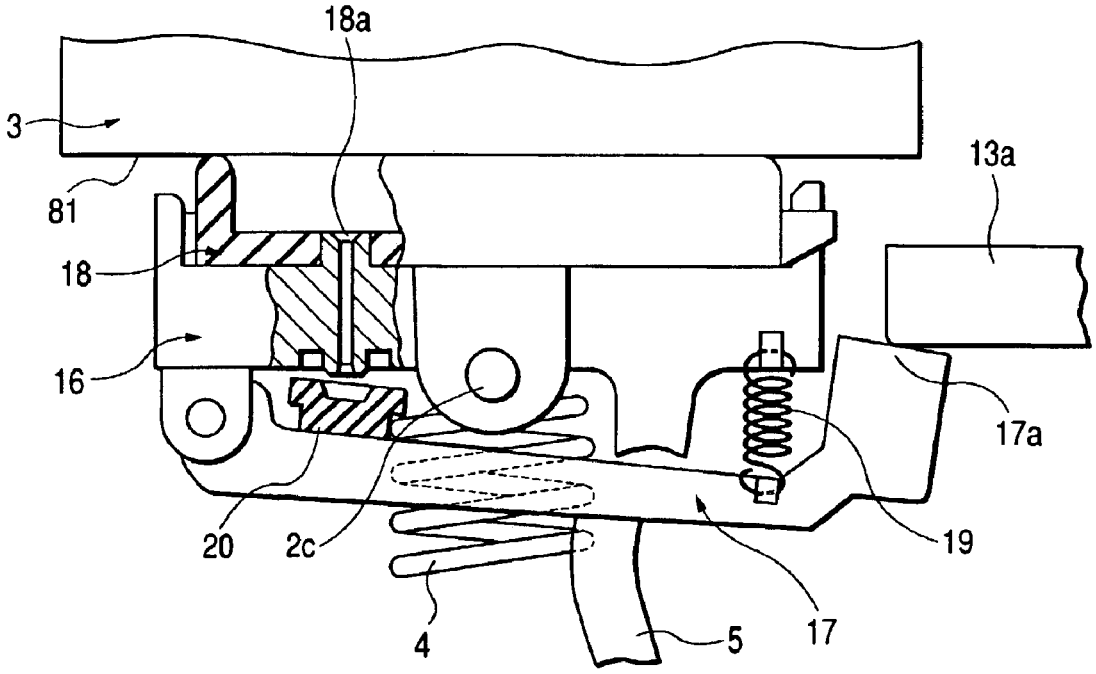
FIG. 19 is a fragmental side view schematically showing a main construction of a second embodiment of a cleaning mechanism portion of an ink jet recording apparatus to which the present invention is applied.
Figure 20:
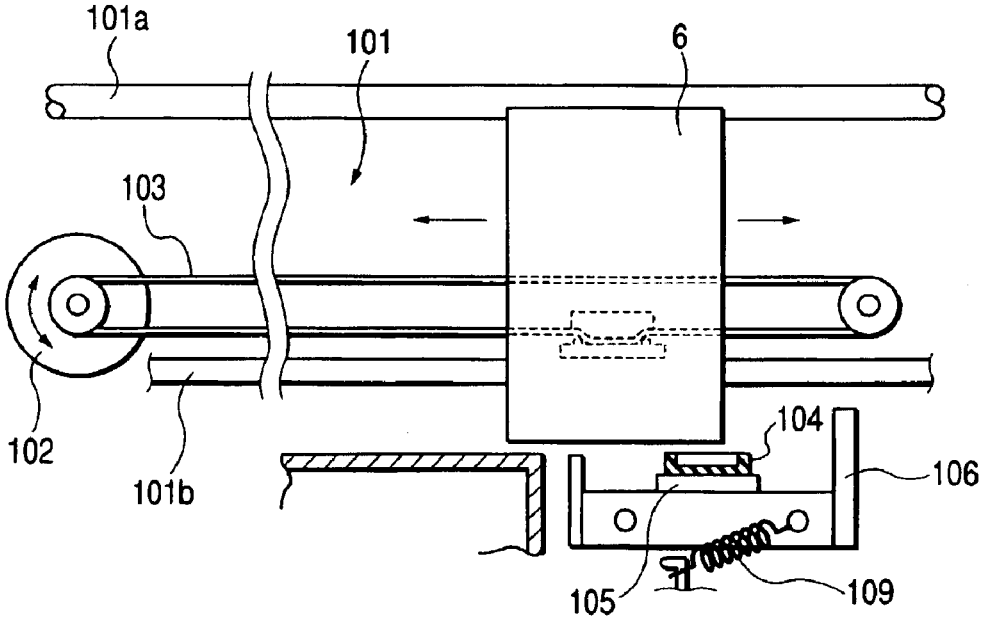
FIG. 20 is a schematic front view showing a cap open condition of a cleaning mechanism portion of a conventional ink jet recording apparatus.
Figure 21:
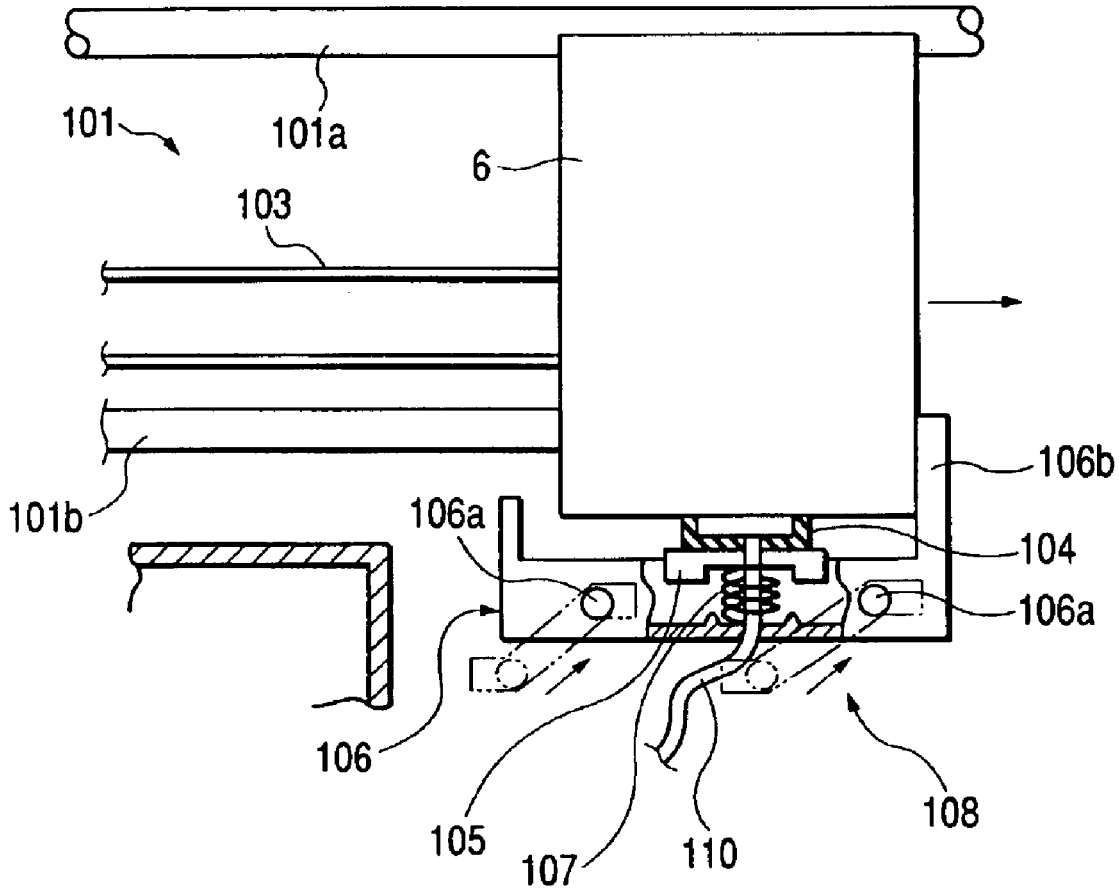
FIG. 21 is a partial-sectional schematic front view showing a cap sealing condition (capping condition) of the cleaning mechanism portion of FIG. 20.

FIG. 19 is a partial-sectional side view, schematically showing a main construction of a second embodiment of a cleaning mechanism portion of an ink jet recording apparatus to which the present invention is applied. In the aforementioned embodiment (the first embodiment) explained in connection with FIG. 1 to FIG. 18, while the cleaning mechanism portion in which the residual ink remaining on the discharge port face 81 of the recording head is removed by opening the one end of the cap was explained, in the second embodiment shown in FIG. 19, in place of the cap one end open means, an open/close valve for communicating the interior of the cap with atmosphere is adopted. Also in FIG. 19, the same or corresponding parts or elements as those in the first embodiment are designated by the same reference numerals. In general, means for removing the residual ink remaining on the discharge port face and the ink in the cap after the suction operation, as well as means for separating the cap itself from the recording head have been known. Also, it has been known to propose means in which an open/close valve for communicating the interior of the cap with atmosphere is provided so that when the suction operation is performed in the condition when the recording head 3 is closely sealed by the cap, the suction operation is performed in a condition when the open/close valve is closed. When idle suction is performed after the suction operation, the residual ink remaining on the discharge port face is removed by activating the pump mechanism again in a condition when the open/close valve is opened.

An opening/closing operation of the atmosphere communicating valve is normally performed by applying force to a cam surface for opening and closing the valve via gear transmission. However, in such a conventional arrangement, since a valve opening/closing mechanism becomes complicated and the number of parts is increased, there is inconvenience such that it is difficult to reduce the cost and it is difficult make the cleaning mechanism portion compact due to arrangement of parts. FIG. 19 shows a construction of a cap holder 16 of a cleaning mechanism portion according to the second embodiment, which can eliminate such inconvenience. Incidentally, an ink jet recording apparatus having the cleaning mechanism portion shown in FIG. 19 substantially includes the same construction as that in the first embodiment explained in connection with FIG. 1 to FIG. 18, so long as it is not specially defined.

In FIG. 19, a cap 18 and the cap holder 16 are provided with atmosphere communication through-holes 18*a*, as well as the suction ports for ink suction. Further, each suction port of the cap 18 or the cap holder 16 is connected to a suction tube 5 similar to that in the first embodiment, thereby constituting the similar ink suction mechanism. An atmosphere communicating valve opening/closing member (rotating member, movable member) 17 suspended by a spring 19 is rotatably supported at a rear surface side of the cap holder 16 so as to enable a rotating movement. The movable member 17 is provided at its tip end with a valve opening cam surface 17*a* similar to the cap open cam surface 2*d* in FIG. 6. An opening/closing valve (atmosphere communicating valve) 20 for opening and closing the atmosphere communicating through-holes 18*a* is secured to a predetermined part of the movable member (rotating member, atmosphere communicating valve opening/closing member) 17. Further, the reference numeral 13*a* in FIG. 19 denotes a cam portion similar to the fixed cam portion 13*a* shown in FIGS. 7, 8, 14 and 15, i.e., the fixed cam portion provided at a predetermined position on the main body of the recording apparatus.

With the above-mentioned arrangement, similar to the first embodiment explained in connection with FIG. 1 to FIG. 18, after the carriage 6 enters into the cleaning mechanism portion and the suction operation is performed at the capping position (position corresponding to FIG. 14, where the opening/closing valve 20 is closed by the action of the spring 19), when the carriage 6 is further shifted in the direction along which the cap slider 7 is pushed (direction toward the innermost end of the cleaning mechanism portion), the fixed cam portion 13*a* of the base portion 13 of the recording apparatus abuts against the cam surface 17*a* of the movable member (atmosphere communicating valve opening/closing member) 17 attached to the cap holder 16, and the movable member 17 is rotated to be lowered, thereby opening the atmosphere communicating valve 20 as shown. In this condition, by activating the negative pressure generating source (pump mechanism and the like) connected to the tube 5, the residual ink remaining on the discharge port face 81 and the ink in the cap can be removed effectively.

As mentioned above, according to the second embodiment shown in FIG. 19, a similar effect of that of the first embodiment can be achieved, and the residual ink after the suction recovery can be removed by opening and closing the atmosphere communicating valve 20 in the condition when the cap 18 is closely contacted with the discharge port face 81 of the recording head 3. Accordingly, similar to the first embodiment, with a simple construction including a fewer number of parts, the ink remaining on the discharge port face during the recording head cleaning operation can be removed effectively. Thus, there is provided an ink jet recording apparatus having the cleaning mechanism portion, which can obtain good recording image quality without ink color mixing.

Incidentally, the present invention can be carried out without limiting the present invention to the number of the recording heads and the number of the discharge port arrays explained in the above-mentioned embodiments. Further, the present invention can be carried out without limiting the present invention to the kind and the number of inks used and, thus, can be applied to, for example, a color ink jet recording apparatus for performing the recording by using plural different color inks, a gradation recording ink jet recording apparatus in which an image is recorded with the same color but plural different densities or an ink jet recording apparatus obtained by combining the aforementioned recording apparatuses, and, accordingly, the present invention includes all of the above-mentioned constructions within the scope thereof.

Further, the present invention can similarly be applied to various constructions having different arrangement relationships between the recording head and an ink tank, such as a construction utilizing an exchangeable ink jet cartridge in which an ink tank is integrally formed with a recording head, a construction utilizing recording means in which an ink tank is detachably mounted to a recording head or a construction in which a recording head and an ink tank are formed separately and they are interconnected via an ink supply path. In this case, the same effect can be achieved. Further, the present invention can similarly be applied to, for example, an ink jet recording apparatus utilizing a recording head driven by an other operating system, such as a recording head using an electrical/mechanical converter such as a piezoelectric element. Also in this case, the same effects can be achieved. Among them, excellent effects can be achieved in an ink jet recording apparatus using a recording head of type in which ink is discharged by utilizing thermal energy. According to such a type, high density recording and highly fine recording can be achieved.

As apparent from the aforementioned explanation, according to the present invention, in an ink jet recording apparatus for recording an image on a recording material by using a recording head mounted on a carriage shifted reciprocally, there is provided a cleaning mechanism for performing a capping operation. By closely contacting a cap with the recording head by shifting a cap slider containing the cap for capping a discharge port portion of the recording head along a cam surface provided on a main body of the recording apparatus by utilizing a shifting movement of the carriage, the discharge port portion is capped. Since the cleaning mechanism portion has cap one end open means in which, after the carriage enters into the cleaning mechanism portion and the recording head is capped by the cap, one end of the cap is opened by shifting the carriage further in an advancing direction ink jet recording apparatus having a cleaning mechanism portion, which can maintain stable recording quality by adequately removing ink remaining on the discharge port face during cleaning processing of the recording head, is provided.

What is claimed is:

1. An ink jet recording apparatus for performing a recording operation by discharging ink from a recording head, comprising:

a carriage on which the recording head is mounted and which is shifted reciprocally;

a cap for capping an ink discharge portion of the recording head; and a cleaning mechanism portion for performing a capping operation by shifting a cap slider holding said cap along a cam surface by utilizing the shifting movement of said carriage, wherein after said carriage enters into said cleaning mechanism portion and the recording head is capped by said cap, when said carriage is further shifted in an advancing direction in a capped condition, one end of said cap is opened.

2. An ink jet recording apparatus according to claim 1, wherein a cap holder holding said cap is rotatably disposed on said cap slider via shaft portions provided on both ends of said cap holder, and a cap open cam is provided at a position spaced apart from said shaft portions of said cap holder in a direction transverse to the axis of said shaft portions so that, when said carriage is shifted to abut said cap open cam against a fixed cam provided on a main body of said recording apparatus, an abutment angle of said cap relative to the recording head is changed.

3. An ink jet recording apparatus according to claim 2, wherein said cap open cam includes an oblique surface for opening one end of said cap by the shifting movement of said carriage, and a parallel surface for maintaining an open amount of said cap constant.

4. An ink jet recording apparatus according to claim 2, wherein an angle of a cam oblique surface of said fixed cam before said cap abuts against the recording head, is different from an angle of the cam oblique surface thereof after said cap abuts against the recording head.

5. An ink jet recording apparatus according to claim 4, wherein said fixed cam includes a cam oblique surface formed with a reversed angle opposite to the cam oblique surface before said carriage reaches a capping position, within a range in which said carriage is shifted from the capped position to a position where one end of said cap is opened.

6. An ink jet recording apparatus according to claim 4, wherein positioning of said cap slider with respect to said main body of said recording apparatus is performed by pinching the cam surface provided on said main body of said recording apparatus for guiding a shifting movement of said cap slider by a recessed portion provided in a tip end of said cap slider.

7. An ink jet recording apparatus according to claim 1, wherein said recording head has a plurality of different color discharge port arrays and an end portion of said cap near said discharge port arrays is opened.

8. An ink jet recording apparatus according to claim 7, wherein, when said plurality of different color discharge port arrays are arranged offset from a center position of said cap in a conveying direction of a recording material, an ink suction port of said cap is provided at a position opposed to said discharge port arrays with respect to the conveying direction of the recording material.

9. An ink jet recording apparatus according to claim 8, wherein a conveying surface of the recording material is arranged obliquely with respect to an inserting surface of said recording apparatus so that a sheet discharging side of the conveying surface becomes lower than a sheet feeding side of the conveying surface, and said plurality of discharge port arrays are in parallel along a direction transverse to the conveying direction of the recording material, and the ink suction port of said cap is provided in the sheet discharging side at a position opposed to said discharge port arrays, and the end of said cap near said discharge port arrays is opened.

10. An ink jet recording apparatus according to claim 1, wherein the interior of said cap is connected to negative pressure generating means so that, after negative pressure is generated within said cap by said negative pressure generating means to suck ink in a condition that discharge ports of the recording head are closely sealed by said cap, one end of said cap is opened by further shifting said carriage in the advancing direction while activating said negative pressure generating means.

11. An ink jet recording apparatus according to claim 1, wherein said cap slider is provided with a fitting pin for fitting into a fitting hole of the recording head with a predetermined gap therebetween within a shifting range of said carriage further advancing from a capped position where said cap abuts against the recording head.

12. A cleaning mechanism portion for an ink jet recording apparatus for performing a recording operation by discharging ink from a recording head, comprising:

a cap for capping an ink discharge portion of the recording head; and a cleaning mechanism portion for performing a capping operation by shifting a cap slider holding said cap along a cam surface by utilizing a shifting movement of a carriage for mounting the recording head thereon, wherein after the carriage enters into said cleaning mechanism portion and the recording head is capped by said cap, when the carriage is further shifted in an advancing direction in a capped condition, one end of said cap is opened.

* * * * *